US008393765B2

(12) United States Patent
Sugishita et al.

(10) Patent No.: US 8,393,765 B2
(45) Date of Patent: Mar. 12, 2013

(54) LUMINAIRE

(75) Inventors: Naoki Sugishita, Ito (JP); Homare Takai, Izunokuni (JP); Takafumi Oishi, Yokohama (JP); Yasuhiko Ishii, Numazu (JP); Masanao Hieda, Numazu (JP); Yutaka Hashimoto, Sunto-Gun (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 587 days.

(21) Appl. No.: 12/630,414

(22) Filed: Dec. 3, 2009

(65) Prior Publication Data

US 2010/0142202 A1 Jun. 10, 2010

(30) Foreign Application Priority Data

| | | |
|---|---|---|
| Dec. 5, 2008 | (JP) | 2008-311217 |
| Dec. 5, 2008 | (JP) | 2008-311418 |
| Dec. 26, 2008 | (JP) | 2008-332886 |
| Dec. 26, 2008 | (JP) | 2008-334065 |
| Dec. 26, 2008 | (JP) | 2008-334444 |

(51) Int. Cl.
*F21V 17/00* (2006.01)

(52) U.S. Cl. ..... 362/375; 362/147; 362/224; 362/804; 362/225; 362/367; 362/260; 362/572

(58) Field of Classification Search ..... 362/147, 362/224, 375, 804, 225, 367, 260, 572
See application file for complete search history.

(56) References Cited

U.S. PATENT DOCUMENTS

| | | | | |
|---|---|---|---|---|
| 2002/0118544 | A1 | 8/2002 | Wang | |
| 2006/0109665 | A1 * | 5/2006 | Rupert et al. | 362/382 |
| 2008/0068831 | A1 * | 3/2008 | Wilson et al. | 362/147 |
| 2009/0034247 | A1 * | 2/2009 | Boyer | 362/225 |

FOREIGN PATENT DOCUMENTS

| | | |
|---|---|---|
| CN | 2511859 | 9/2002 |
| CN | 200968529 | 10/2007 |
| DE | 944511 | 6/1956 |
| EP | 2034238 | 3/2009 |
| GB | 581959 | 10/1946 |
| GB | 896946 | 5/1962 |
| JP | 50-029479 | 4/1975 |
| JP | 60-149180 | 10/1985 |
| JP | 02-084213 | 6/1990 |
| JP | 08-007636 | 1/1996 |

(Continued)

OTHER PUBLICATIONS

English language abstract of JP-2008-257903.

(Continued)

*Primary Examiner* — William Carter
(74) *Attorney, Agent, or Firm* — DLA Piper LLP (US)

(57) ABSTRACT

A luminaire includes a light-emitting unit, a main body frame, a support frame, and a lighting unit. The light-emitting unit mounts light-emitting elements. The main body frame supports the light-emitting unit, and is formed rectangular having a hook-shaped engaging piece on one side. The support frame is formed rectangular surrounding the outer periphery of the main body frame, and has a groove-shaped receiving place to engage with the engaging piece of the main body frame, on one internal side. The lighting unit turns on the light-emitting elements.

6 Claims, 21 Drawing Sheets

FOREIGN PATENT DOCUMENTS

| | | |
|---|---|---|
| JP | 08-017229 | 1/1996 |
| JP | 2001-005409 | 1/2001 |
| JP | 2001-014935 | 1/2001 |
| JP | 2002-117705 | 4/2002 |
| JP | 2008-257903 | 10/2008 |

OTHER PUBLICATIONS

Machine English language translation of JP-2008-257903.
English language abstract of JP-2002-117705.
Machine English language translation of JP-2002-117705.
English language abstract of JP-2001-005409.
Machine English language translation of JP-2001-005409.
English-language Search Report issued in counterpart European Application No. 09 01 5084 on May 7, 2010.
Chinese Office Action issued in CN 200910211935.3 on Aug. 31, 2011.
English Language Translation of Chinese Office Action issued in CN 200910211935.3 on Aug. 31, 2011.
English language abstract of CN 200968529, published Oct. 31, 2007.
English language abstract of CN 2511859, published Sep. 18, 2002.
Japanese Office Action issued in JP 2008-332886 on Nov. 20, 2012.
English Language Translation of Japanese Office Action issued in JP 2008-332886 on Nov. 20, 2012.
Japanese Office Action issued in JP 2008-311217 on Dec. 4, 2012.
English Language Translation of Japanese Office Action issued in JP 2008-311217 on Dec. 4, 2012.
Japanese Office Action issued in JP 2008-311418 on Jan. 8, 2013.
English Language Translation of Japanese Office Action issued in JP 2008-311418 on Jan. 8, 2013.
English Language Abstract of JP 2001-014935 published Jan. 1, 2001.
English Language Translation of JP 2001-014935 published Jan. 1, 2001.
English Language Abstract of KJP 08-017229 published Jan. 1, 1996.
English Language Translation of KJP 08-017229 published Jan. 1, 1996.
English Language Abstract of JP 08-007636 published Jan. 12, 1996.
English Language Translation of JP 08-007636 published Jan. 12, 1996.

* cited by examiner

LUMINAIRE

CROSS-REFERENCE TO RELATED APPLICATIONS

This application is based upon and claims the benefit of priority from prior Japanese Patent Applications No. 2008-311217, filed Dec. 5, 2008; No. 2008-311418, filed Dec. 5, 2008; No. 2008-332886, filed Dec. 26, 2008; No. 2008-334065, filed Dec. 26, 2008; and No. 2008-334444, filed Dec. 26, 2008, the entire contents of all of which are incorporated herein by reference.

BACKGROUND OF THE INVENTION

1. Field of the Invention

The present invention relates to a luminaire using a light-emitting element such as a light-emitting diode as a light source.

2. Description of the Related Art

A light-emitting diode has been increased in the light-emitting efficiency, and used as a light source. A lighting apparatus using a light-emitting diode as a light source has been commercialized as a relatively large lighting apparatus for home and office use. Jap. Pat. Applin. KOKAI Publication No. JP2008-257903 discloses a lighting apparatus comprising square panels having light-emitting diodes arranged in a checkered pattern on a ceiling. Jap. Pat. Applin. KOKAI Publication No. JP2002-117705 discloses a lighting apparatus, in which a main unit is recessed in a ceiling. This lighting apparatus comprises a main unit recessed and fixed to a ceiling, and a panel-like light source unit fixed to the side frame of the main unit with a hinge having a rod. The light source unit comprises a large number of white light-emitting diodes. Jap. Pat. Applin. KOKAI Publication No. JP2001-005409 discloses a displaying apparatus, in which a large number of displaying units using light-emitting diodes as a light source is recessed in the ceiling of arcade.

The above lighting apparatuses are reduced in weight by making a main body a thin panel by using a light-emitting diode as a light source. Since the installation operation of the lighting apparatus on a' ceiling is required to perform in high places, the operation is difficult. Therefore, it is important to simplify the installation operation. Further, in the lighting apparatus disclosed in Jap. Pat. Applin. KOKAI Publication No. JP2008-257903, as described in paragraph [0011], the panels are installed on the ceiling by using a fixing means such as a screw, which must be removed on maintenance. Thus, the installation operation includes troublesome steps, and the lighting apparatus may not be securely installed.

As for the lighting apparatus shown in Jap. Pat. Applin. KOKAI Publication No. JP2002-117705, according to the description of paragraph [0007] and [0008], the main unit is fixed to a edge of opening on a ceiling by a common method using the elasticity of spring material. Thus, if the main unit assembled with a lighting unit is very heavy, the lighting apparatus may not be securely installed. Particularly, if the lighting apparatus is very large, the equipment may not be supported by sufficient strength. When the equipment is installed on a ceiling, the equipment is fixed to the edge of opening on the ceiling in the state in which the panel-shaped light source unit is previously fixed to the main unit. The installation operation is difficult, because the operation must be performed while supporting a relatively heavy part such as the light-emitting unit. Though a light-emitting diode is adopted as a light source, workability is not improved. Therefore, improvement of the installation operation is required.

Generally, a large-size lighting apparatus uses a large number of light-emitting diodes. A large number of lead wires connecting the light-emitting diodes to a power supply unit are liable to complexly extend. Therefore, it is important that how to connect the lead wires, how to prevent interference between a light-emitting diode and a light source unit, and how to prevent breaking of wire. In the lighting apparatus disclosed in Jap. Pat. Applin. KOKAI Publication No. JP2001-005409, according to the description of paragraph [0007], a large number of lead wires are connected in vertical and horizontal directions. The electrical wires and lead wires of the light-emitting diodes are exposed to the rear side of the light-emitting unit And disturb the installation of the lighting apparatus. Something may contact and damage or break the electrical wires. Owing to the structure, this lighting apparatus is difficult in reducing the size, and the workability in installation is not improved.

Further, in the lighting apparatus described in Jap. Pat. Applin. KOKAI Publication No. JP2001-005409, according to paragraphs [0021] and [0022], two or more panel-shaped lighting units are arranged and fixed to supporting wires. The lighting units are not connected to one another. Thus, clearance is likely to occur between the lighting units. In the lighting apparatus comprising two or more light-emitting units, if a clearance is present between adjacent light-emitting units, light may leak from the clearance. Therefore, the lighting apparatus comprising two or more light-emitting units is required to have a structure causing no clearance between adjacent light-emitting units.

BRIEF SUMMARY OF THE INVENTION

A luminaire according to an embodiment of the invention is securely installed in a part, such as a ceiling, and is simplify the installation operations. The luminaire comprises a light-emitting unit, a main body frame, a support frame, and a lighting unit, for example. The light-emitting unit comprises light-emitting elements. The main body frame supports the light-emitting unit, and is formed rectangular having a hook-shaped engaging piece on one side. The support frame is formed square surrounding the outer periphery of the main body frame, and has a groove-shaped receiving place to engage with the engaging piece of the main body frame, on one internal side. The lighting unit turns on the light-emitting elements.

The light-emitting unit comprises a base substrate, a reflector, and a terminal unit. The base substrate is a plate, on which two or more light-emitting elements are mounted. The reflector is attached on the side of the base substrate, on which the light-emitting elements are mounted, and has a reflection surface formed by slopes surrounding each light-emitting element. The terminal unit is mounted on the base substrate, and connected to the light-emitting elements.

The lighting unit comprises a case, and a lighting circuit. The case is fixed to the support frame, and is suspended from a ceiling with a suspension bolt. The lighting circuit is housed in the case. In this case, the case comprises a top plate, a side plate which continued from the top plate, and a support port which is opened across the top plate and side plate. The support port comprises a hitching part, and a entering part. The hitching part is provided in the top plate, and is formed to permit insertion of the suspension bolt and not to permit insertion of a nut to be attached to the suspension bolt. The entering part is provided in the side plate continuing to the hitching part, and is formed to permit insertion of the nut attached to the suspension bolt.

The lighting circuit has a power cable extending from a side in which the case and the support frame are jointed. The light-emitting unit has a lead wire extending from the terminal unit arranged on the side having the engaging piece. The power cable is connected to the lead wire. The support frame has two or more spots to assemble the case along the corresponding side.

The luminaire further comprises an engagement unit to hold the main body frame inside the support frame. The engagement unit consists of a stopper piece, and a lock mechanism. The stopper piece is provided in one of an outer peripheral edge of the main body frame opposite to a side having the engaging piece, and an inner peripheral edge of the support frame adjacent to the outer peripheral edge. The stopper piece moves relatively to the main body frame and support frame, and engages them. The lock mechanism holds the stopper piece at a position to engage the main body with the support frame.

The engagement unit may further comprise a shaft having a stopper piece, and a bearing capable to rotationally move the stopper piece about the shaft. In this case, the lock mechanism is provided between the shaft and bearing, and holds the stopper piece to a rotational position where the main body frame engages with the support frame.

When the light-emitting unit has a plurality of the base substrates, each terminal unit of the base substrates is arranged in a cavity surrounded by the reflector and base substrate. The terminal units provided on adjacent base substrates are connected through connecting lead wires arranged in the cavity.

When the light-emitting unit has a plurality of the reflectors, each reflector has a jointing piece extending perpendicularly from the outer periphery to the base substrate. The reflectors are arranged so that the jointing pieces are opposed to each other and the adjacent outer peripheries are fit. The jointing pieces of the adjacent reflectors are united with each other by a fastening means which determines the relative positions and fastens the jointing pieces. The luminaire configured as above is easy to install in an installation place on a ceiling.

In the invention, the luminaire is preferably applied to relatively large luminaire installed on a ceiling, such as luminaire for home, office and other facilities. The luminaire of the invention may be applied to small luminaire. The luminaire of the invention may also be applied to luminaire, which is recessed in an appropriate installation site on a ceiling, or directly assembled to a ceiling.

In the invention, the light-emitting element may use a semiconductor such as a light-emitting diode, an organic electroluminescence (EL), and semiconductor laser, as a light-emitting source. An incandescent lamp such as a small halogen lamp or a small cold cathode fluorescent lamp may be used as a light-emitting source, as long as it can form a flat light-emitting unit. The light-emitting element is not limited to a white light-emitting element. According to the purposes of the luminaire, red, blue or green light-emitting element may be used, or these colors may be combined.

Necessary number of light-emitting elements of the light-emitting unit are selected and arranged on a substrate. The whole figure of the unit is square or rectangular, and forms a flat surface light source. The light-emitting unit comprises sixteen light-emitting element groups, for example. The light-emitting unit may comprise one or more, four for example, light-emitting element groups. The shape of the light-emitting unit may be selected from rectangle shape which include a linear long bar, round shape which is circle or ellipse, or polygonal shape which is hexagon or octagon.

The light-emitting unit may have a reflector to reflect light from a light-emitting element, for example. The light-emitting unit may be provided with a transmissive plate made of opaque or translucent synthetic resin or reinforced glass, on the front side of the light-emitting unit to cover the light-emitting element. A lattice-shaped light control unit may be provided on the front side of the light-emitting unit.

The main body frame supports the light-emitting unit on the inner peripheral side, and forms a square equipment body together with the light-emitting unit. The main body frame is preferably made of heat-resistant weather-resistant insulating synthetic resin, such as polybutylene terephthalate (PBT). The main body frame may be made of a steel plate or metal such as stainless steel or lightweight material, such as aluminum, with high heat conductivity, considering heat radiation performance.

The equipment main body comprises a main body frame and a support frame. The equipment main body may be a housing comprising a single piece. The structure connecting the main body frame to the support frame is configured to be easily removed by engaging a engaging piece of the main body frame with a groove of the support frame. The structure connecting the main body frame to the support frame may be an ordinary hinge or a permanently-set hinge mechanism.

The base substrate is a part to mount light-emitting elements. Therefore, as the light-emitting unit is formed linear, round or polygonal, the base substrate is formed to meet the shapes of the light-emitting units. The base substrate shall be formed to meet the equipment main body, and may not correspond to the shape of the light-emitting unit.

The engaging piece is made in the form of a hook projecting on one side of the rectangular main body frame, and is preferably formed in one piece with the main body frame made of synthetic resin, for example. A separate hook-shaped metallic engaging piece may be provided to one side of the main body frame.

The lighting unit consists of a lighting circuit, which converts ac 100V into dc 24V, and supplies the converted dc voltage to a light-emitting diode, for example. The lighting unit includes a case member to install the lighting circuit. The lighting unit is allowed to be supported by the equipment main body.

Once the lighting unit is assembled to the support frame, the lighting unit is installed together with the support frame when the support frame is installed on a ceiling. This facilitates installation of the luminaire. The length of the lead wire used for wiring and connecting the lighting unit and light-emitting unit can be reduced, when the terminal unit of the lighting unit is provided close to the engaging piece of the main body frame. Since the lead wire does not disturb the installation and maintenance operations for the luminaire, the operations become easily.

The engagement unit moves the stopper by the rotational operation, and engages the main body frame with the support frame. This facilitates the operation of assembling the main body frame and support frame. The engagement unit is configured to engage the frames by two or three times of simple rotational operation or sliding operation. The lock mechanism to control the movement of the stopper may be configured to fit a projection into a recess, or to fit a projection into a hole or groove, so as to release the locking. The lock mechanism is configured not only to control movement, but also to release the locking. However, when the installation operation is given priority, the lock mechanism needs not to be releasable. The lock mechanism may not have a release function.

The base substrate comprises a substrate and a circuit board. The substrate is made of synthetic resin, or metal with high heat conductivity, such as steel, aluminum and copper. The circuit board is a part to mount light-emitting elements. The circuit board may be made of metal such as copper and aluminum, or nonmetal such as glass epoxy material, paper phenol material, and glass composite. The circuit board may also be made of ceramics when the cost is reasonable. Further, the base substrate may comprise a circuit board only. A light-emitting diode chip as a light source is mounted on a wiring pattern formed on the circuit board. A specific means is not used for forming and mounting the circuit board.

The support frame supports the main body frame on the inner periphery, and forms the square luminaire together with the light-emitting unit and main body frame. Heat-resistant weather-resistant insulating synthetic resin, such as polybutylene terephthalate (PBT), is suitable for material of the support frame, like the main body frame. The main body frame may be made of a steel plate or metal such as stainless steel or lightweight aluminum with high heat conductivity, considering radiation performance.

The receiving place is formed as a groove on each side, or four inner sides, of the square support frame. The receiving place may be formed only on one side, not on all of the four sides of the support frame. The receiving place may also be formed in one piece with the synthetic resin support frame, or a separate groove-shaped metallic member may be attached to each side of the support frame.

The reflector is optically designed to be able to obtain desired light distribution. The reflector is configured to have a reflection surface covering the area around the light-emitting element to obtain light distribution rotationally symmetric with respect to the center axis of the light-emitting element. The reflection surface is a side of so-called square pyramid, or a concave side of a conical having a rectangular opening shape. On the rear side of the reflection surface, a cavity having a triangular vertical cross-section is formed. The reflection surface may be formed as a concave of a conical having a circular shape of opening. In this case, on the rear side of a curved and inclined bowl-shaped reflection surface, a corresponding cavity is formed. The reflection surface is not limited to a specific shape.

As a material of reflector, heat-resistant weather-resistant insulating synthetic resin, such as polybutylene terephthalate (PBT), acrylic, or acrylonitrile-Butadiene-Styrene (ABS) is used considering radiation performance. A reflector is formed in one piece. The surface of the reflector may be painted white, or mirror finished, or semi-mirror finished by evaporating or plating metal such as aluminum and silver. Further, the reflector may be made of metal such as aluminum and copper, and may be painted white, evaporated, or plated.

The reflector may be provided in the number corresponding to the number of light-emitting elements, or the number of light-emitting element groups. Reflectors formed separately may be combined to obtain the same light distribution. Reflectors with different light distribution may be combined. One common reflector may be provided for one or more light-emitting elements or light-emitting element groups. The reflector is arranged so that it is layered on the base substrate. The reflector is combined with a light-emitting element and base substrate, forming a light-emitting unit as a module.

For example, when four reflectors constitute a reflection unit, the jointing pieces of adjacent reflectors are diagonally placed at the corners of each reflector. Each jointing piece is formed as a ¼-divided part of a cylinder so that four jointing pieces form one cylinder when they are combined. The shape of a jointing piece may be rectangular or polygonal, and the shape of combined jointing pieces may be a square or polygonal column. The shape of a jointing piece may not be a perfect circle in cross section when it is combined with other jointing pieces. Clearance is allowed between jointing pieces. Namely, a jointing piece may have any form as long as no clearance exists between adjacent reflectors when combined with other jointing pieces. A jointing piece may be formed in one piece with the reflector, or may be separately formed and attached to the corners of a reflector.

The terminal unit connected to the light-emitting element is configured to electrically connect the lead wires, which supply electrical power to the light-emitting elements, provided on the base substrate. The light-emitting element and terminal are connected by using a connector on a wiring pattern formed on the base substrate. The lead wires may be directly soldered or screwed to the wiring pattern. Wires may be directly connected to the light-emitting elements without using a wiring pattern.

The lead wires are used to connect the terminal unit to the light-emitting unit As a power supply, or to connect adjacent light-emitting units. The lead wires and terminal unit are connected through the above-mentioned connector. The lead wires may be directly connected to the wiring pattern on the base substrate by soldering and or screwing. The lead wires connected to the terminal unit are housed in the cavity formed between the reflector and base substrate. The lead wires may be completely or partially housed in the cavity, as long as the lead wires do not disturb the installation operation.

When the light-emitting unit having a plurality of the base substrates is used in one luminaire, the terminal unit is located in the cavity formed between the reflector and base substrate. The terminal units are connected with lead wires arranged in the cavity. Therefore, the lead wires are not exposed to the rear side of the luminaire.

A fastening means unites adjacent reflectors by bundling the jointing pieces, and determines the relative positions of the reflectors. A fastening means may use a circular jointing ring made of metal or synthetic resin. The jointing ring gathers the jointing pieces by bundling them. The jointing ring may be a C-shaped incomplete ring spring member. A fastening means may use a wire or string for bundling and uniting the jointing pieces. These fastening means may be attached assuming later removal. When the jointing pieces are bonded by adhesive means, the adhesive means is included in the fastening means. The above-mentioned fastening means may be combined. Clearance between the reflectors is allowed as long as it comes within an allowable range of light leakage, or it does not spoil the appearance of the equipment.

When the light-emitting unit having a plurality of the reflectors is used in one luminaire, the reflectors can be easily assembled without clearance by bundling the jointing pieces by the jointing ring. Therefore, the reflectors do not leak light.

As cavities formed in the reflectors are combined, a cavity formed between the reflector and base substrate at the junction of adjacent reflectors may be larger than a single cavity. A cavity may be formed only in one reflector. Adjacent reflectors are preferably joined without clearance from the viewpoint of the equipment appearance. Clearance between adjacent reflectors is allowed as long as it does not spoil the appearance of the equipment.

When the case of the lighting unit has a support port which includes a entering part and a hitching part, the luminaire can be securely installed in an installation site on a ceiling, and the installation workability is improved. The position to attach the case of the lighting unit to the support frame can be selected from two or more positions. This provides excellent workability in the luminaire.

The luminaire comprising the stopper piece and lock mechanism as the engagement unit can securely engage the equipment main body with the support frame. The equipment main body can be engaged with the support frame by a simple operation, when the stopper piece is configured to be rotationally movable. The stopper piece is not carelessly moved, and the engagement unit is not released, when the lock mechanism is provided.

In the luminaire, in which the terminal unit and lead wires are arranged in the cavity between the reflector and base substrate, the lead wires can be easily handled, and the lead wires do not disturb the installation operation. Further, by arranging the reflectors flatly along the base substrate, a larger light-emitting unit can be formed. The terminal units provided in the reflector and the lead wires connecting the terminal units are housed in the cavity formed at the junction of adjacent reflectors. As the lead wires are not exposed, the lead wires are easy to handle, and improves the workability of installing the luminaire.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A luminaire 10 according to a first embodiment of the invention will be explained with reference to FIG. 1 to FIG. 20.

Figure 1:
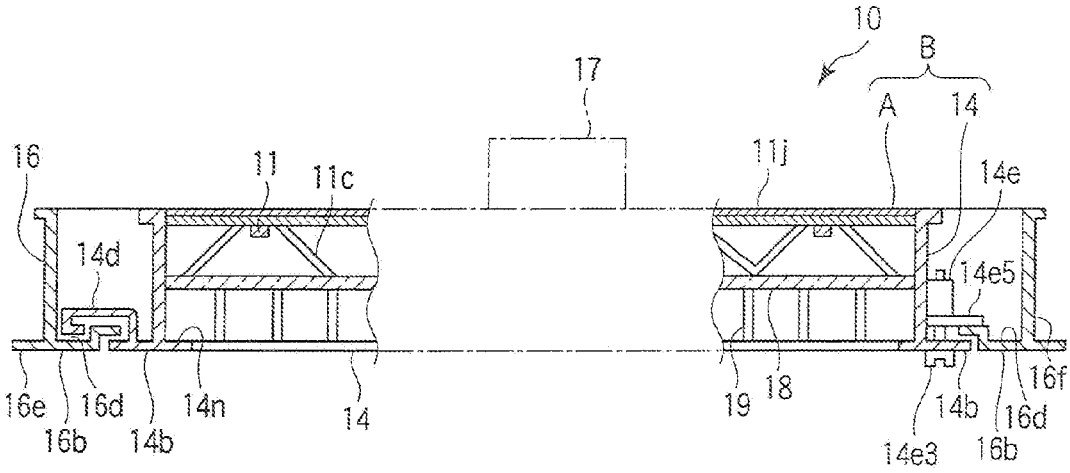
FIG. 1 is a sectional view of a luminaire according to a first embodiment of the invention.

A luminaire 10 is a recessed ceiling type made in the form of a flat square panel. As shown in FIG. 1, the luminaire 10 comprises an equipment main body B, a support frame 16, an engagement unit 14*e*, and a lighting unit 17. The equipment main body B comprises a light-emitting unit A, and a main body frame 14. The light-emitting unit A comprises light-emitting elements 11 forming a light-emitting unit. The main body frame 14 holds the light-emitting unit A on the inner periphery. The support frame 16 holds the main body frame 14 on the inner periphery, and pivotally supports one end portion of the main body frame 14. The engagement unit 14*c* engages the other end portion of the main body frame 14 with the support frame 16. The lighting unit 17 lights up the light-emitting elements 11.

Figure 5:
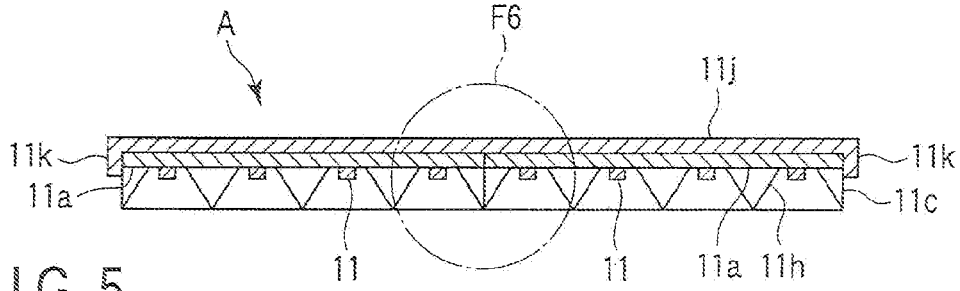
FIG. 5 is a sectional view of the light-emitting unit along the line F5-F5 in FIG. 4.

The light-emitting element 11 comprises a light-emitting diode (LED), and a fluorescent substance. In this embodiment, the light-emitting element comprises a blue LED chip, and a yellow fluorescent substance excited by the LED chip, and emits white high power light. The light-emitting unit A comprises a base substrate 11*a*, a reflector 11*c*, and a terminal unit 40, as shown in FIG. 5.

Figure 4:
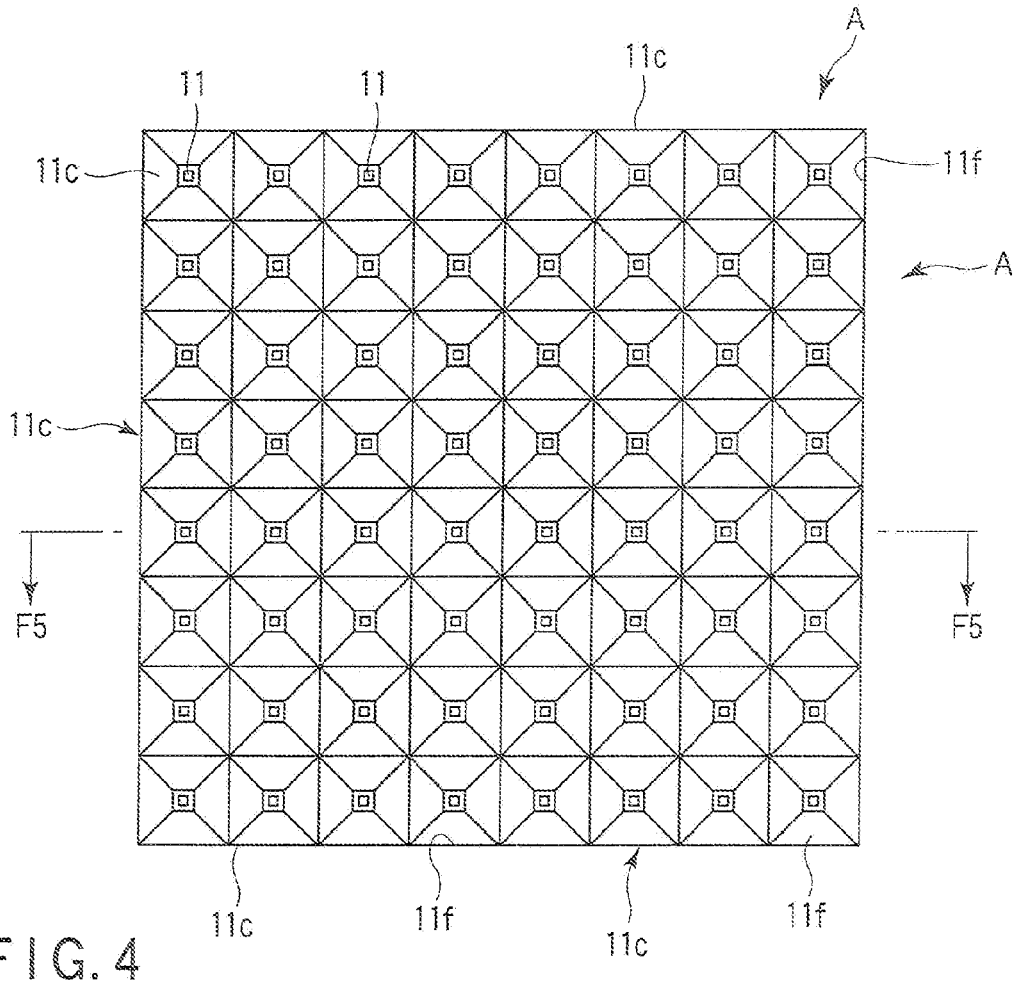
FIG. 4 is a front view showing a light-emitting unit of the luminaire of FIG. 1.

The base substrate 11*a* is made of heat-resistance weather-resistant insulating synthetic resin, white polybutylene terephthalate (PBT) in this embodiment, and is molded as a square flat plate. The base substrate 11*a* may comprise a glass epoxy or aluminum substrate. The light-emitting elements 11 are mounted on the front surface of the base substrate 11*a*. The light-emitting elements 11 are arranged in square, four each in vertical and horizontal directions, total 16 pieces. Four base substrates of the same shape are combined. As shown in FIG. 4, the light-emitting unit A has sixty-four light-emitting elements 11. The light-emitting elements 11 are connected in series by the wiring formed on the rear side of the base substrate 11*a*.

Figure 6:
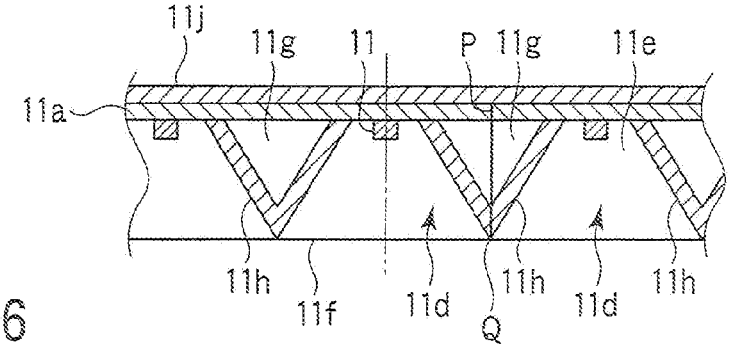
FIG. 6 is a sectional view of the light-emitting unit with the part F6 in FIG. 5 magnified.

The reflector 11*c* is provided on the front surface of the base substrate 11*a*, on which the light-emitting elements 11 are mounted. The reflector 11*c* is made of heat-resistant insulating synthetic resin, white polybutylene terephthalate (PBT) in this embodiment. As shown in FIG. 4, the reflector 11*c* has a square pyramid concave portion 11*d* corresponding to the number of light-emitting elements 11. As shown in FIG. 5 and FIG. 6, the concave portion 11*d* is shaped like a conical or funnel, whose cross section parallel to the base substrate 11*a* is rectangular.

As shown in FIG. 4, the light-emitting element 11 is located at the center of the opening 11*e* at the bottom of the concave portion 11*d*. In other words, the light-emitting element 11 is provided in each concave portion 11*d* of the reflector 11*c*. The reflector 11*c* has an exit port 11*f* to emit light from the light-emitting element 11 to the outside. The exit port 11*f* is formed rectangular as shown in FIG. 4.

The reflector 11*c* is molded in one piece with sixteen concave portions 11*d* corresponding to each light-emitting element 11. As shown in FIG. 6, the reflector 11*c* is molded so that any part of the wall forming the concave portion 11*d* has the same thickness. In other words, a tunnel-shaped cavity 11*g* is inevitably formed between the rear side of the reflector 11*c* and the base substrate 11*a*. The cavity 11*g* formed between the rear side of the reflector 11*c* and the base substrate 11*a* has a triangular vertical cross section. The cavity 11*g* is extended in parallel crosses between the light-emitting elements 11, and in parallel to the sides of the base substrate 11*a* and reflector 11*c*.

The reflector 11*c* is configured to have a reflection surface 11*h* on the inside surface of the square conical-shaped concave portion 11*d*, to obtain light distribution rotationally symmetric with respect to the center axis of the light-emitting element 11. The reflection surface 11*h* covers the part surrounding the light-emitting element 11, and extends to the square exit port 11*f*. The reflection surface 11*h* may be mirror finished by evaporating or plating aluminum or silver.

Four square base substrates 11*a* and reflectors 11*c* configured as described above form a square light-emitting unit A, that is a light-emitting unit, as shown in FIG. 4. In other words, the square base substrate 11*a* having sixteen light-emitting elements 11, and the square reflector 11*c* having sixteen concave portions 11*d* are arranged in vertical and horizontal directions, two in each direction, total four. The light-emitting unit A has a radiator plate 11*j* on the rear side of the base substrate 11*a* opposing the side provided with the reflector 11*d*. The radiator plate 11*j* is made of a steel plate or metal such as aluminum with high heat conductivity, a square steel plate in this embodiment, and is formed in one piece with a brim 11*k* rising from each side of the outer periphery.

The base substrate 11*a* is positioned on the radiator plate 11*j* by the brim 11*k*. The reflector 11*c* is applied to the front side of the base substrate 11*a*. The reflector 11*c* is fastened to the base substrate 11*a* from the rear side of the radiator plate 11*j* with a screw, so that the bottom of the reflector closely contacts the surface of the base substrate 11*a*. The reflector 11*c* may be attached to the front surface of the substrate 11*a* with heat-resistant insulating adhesive made of silicon resin or epoxy resin. The square flat light-emitting unit A, which has the light-emitting elements 11 as a light source, is configured as described above.

Figure 8:
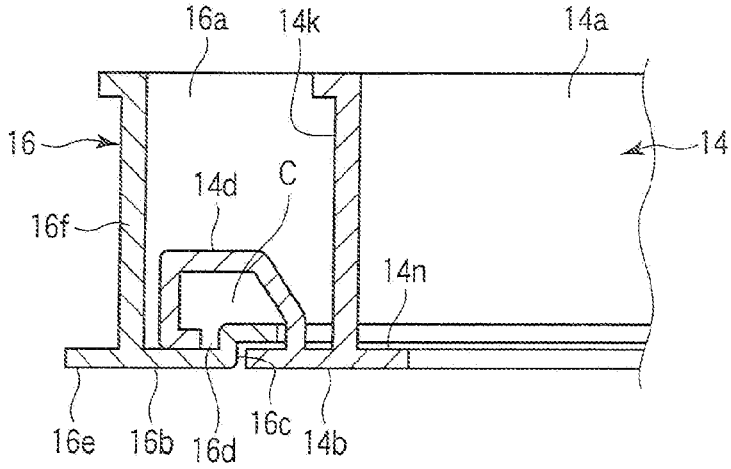
FIG. 8 is a magnified sectional view of a engaging piece and receiving place of the luminaire shown in FIG. 1.

The main body frame 14 is made of metal with high heat conductivity, white painted aluminum in this embodiment, and is formed in one piece with a square frame body 14*a*. The frame body 14*a* is sized to contain the light-emitting unit A. The equipment main body B of the square luminaire is constructed by inserting the light-emitting unit A into the main body frame 14. The main body frame 14 is formed in one piece with an outer flange 14*b* that is an ornamental frame projecting outward, on four outer sides the frame body 14*a*. The outer flange 14*b* has a hook-shaped projecting engaging piece 14*d* on one side, as shown in FIG. 8. The engaging piece 14*d* is extended along one side of the frame body 14*a*, having a predetermined cross section shape, and is formed in one piece with the outer flange 14*b* of the frame body 14*a*. The engaging piece 14*d* engages with a receiving place 16*d* of the support frame 16 described later, and connects one end of the equipment body B pivotally turnable to the support frame 16.

Figure 2:
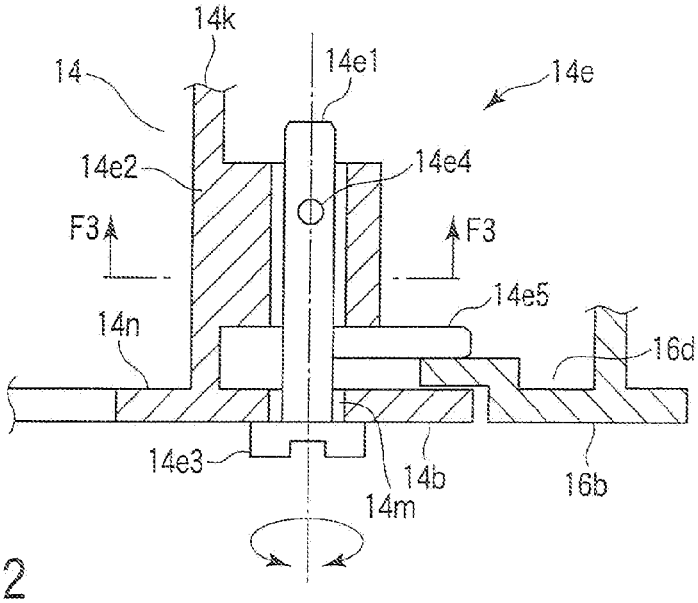
FIG. 2 is a sectional view showing an engagement unit of the luminaire of FIG. 1.
Figure 3:
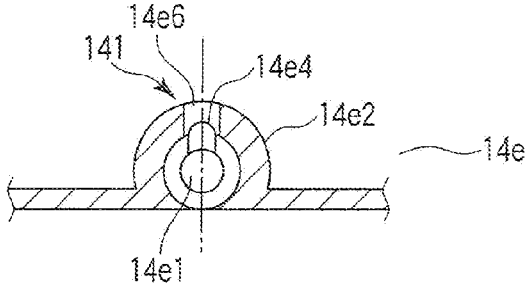
FIG. 3 is a sectional view showing the engagement unit along the line F3-F3 in FIG. 2.

The main body frame 14 has an engagement unit 14*e* at substantially the middle of the side opposing the side on which the engaging piece 14*d* is formed, as shown in FIG. 1 to FIG. 3. The engagement unit 14*e* has a function to hold the main body frame 14 inside the support frame 16. The engagement unit 14*e* comprises a stopper 14*e*1, a bearing 14*e*2, a screw head 14*e*3, a projection 14*e*4, a stopper piece 14*e*5, and a recess 14*e*6, as shown in FIGS. 2 and 3.

As shown in FIG. 2, the stopper 14*e*1 is a round shaft made of metal or synthetic resin, a round metallic shaft in this embodiment, and formed in one piece with the screw head 14*e*3 and stopper piece 14*e*5. The bearing 14*e*2 is made of synthetic resin, formed in one piece with the side plate 14*k* of the main body frame 14, and movably supports the stopper 14*e*1. The bearing 14*e*2 is shaped cylindrical extending to the outer periphery of the side plate 14*k*, as shown in FIG. 3. The screw head 14*e*3 is provided in the end portion of the stopper 14*e*1, penetrating the outer flange 14*b* of the frame body 14*a*. The stopper piece 14*e*5 is projected longwise in the direction orthogonal to the center of the axis in one piece with the stopper, as shown in FIGS. 1 and 2.

The screw head 14*e*3 has a groove to rotate the stopper 14*e*1. As long as the stopper 14*e*1 can be rotated, the shape of the groove may be linear or cross, or may be a hexagonal hole or a particular shape corresponding to a specific jig. By making the screw head in the form not applicable to a common tool, operation by a third person can be prevented.

The projection 14*e*4 and recess 14*e*6 form a lock mechanism 141 as shown in FIG. 3. The lock mechanism 141 is provided between the stopper 14*e*1 and bearing 14*e*2. The projection 14*e*4 is provided at the middle of the stopper 14*e*1 apart from the stopper piece 14*e*5 in the direction to the center of axis, and is projected in the direction orthogonal to the center of axis. The recess 14*e*6 is provided at the middle of the bearing 14*e*2, and engages with the projection 14*e*4 when the stopper piece 14*e*5 comes to the position where the main body frame 14 engages with the support frame 16. As shown in FIG. 3, the recess 14*e*6 of this embodiment is formed by a small hole penetrating the cylindrical wall of the bearing 14*e*2.

The metallic shaft of the stopper 14*e*1 is inserted into the bearing 14*e*2 through a penetrated hole 14*m* formed in the outer flange 14*b* of the main body frame 14. When the screw head 14*e*3 is turned, the stopper piece 14*e*5 is separated from the side plate 14*k* of the main body frame 14, and engages with the inner flange 16*b* of the support frame 16. At the same time, the projection 14*e*4 of the lock mechanism 141 is rotated. At this time, the resin-made bearing 14*e*2 is bent by its own elasticity. In the state in which the stopper piece 14*e*5 engages with the inner flange 16*b*, the projection 14*e*4 fits in the recess 14*e*6 of the bearing 14*e*2. As a result, the rotation of the stopper 14*e*1 is controlled, and the stopper is locked.

The inner flange 14*n* is formed in one piece with the main body frame 14 in the inner periphery of the frame body 14*a* as shown in FIGS. 1 and 2. The inner flange 14*n* is an ornamental frame projecting to the inside of the frame body 14*a*. The inner flange 14*n* locks the light-emitting unit A, so that the light-emitting unit A does not come out the main body frame 14 when it is inserted into the main body frame 14. The light-emitting unit A is held in the main body frame 14 so that when the unit A is inserted into the main body frame 14, four locations of the unit A are pressed to the inner flange 14*n* of the main body frame 14 by a pressing member such as a leaf spring.

The luminaire 10 of this embodiment comprises a transmissive plate 18 and a light control unit 19 as shown in FIG. 1. The transmissive plate 18 is arranged on the front side that is a projecting side of the light-emitting unit A. The transmissive plate 18 is formed square, and made of translucent opaque synthetic resin, so as to cover the light-emitting element 11 and reflector 11*c*. The light control unit 19 is arranged between the transmissive plate 18 and inner flange 14*n*. The light control unit 19 is made in the form of a square lattice to be housed in the frame body 14*a*, and has sufficient length in the direction of the light emitted from the light-emitting element 11. The transmissive plate 18 and light control unit 19 are inserted into the frame body 14*a* of the main body frame 14, together with the light-emitting unit A. In the inner flange 14*n* of the main body frame 14, the light control unit 19, transmissive plate 18 and light-emitting unit A are layered in this order, and held by a holding member.

Figure 7:
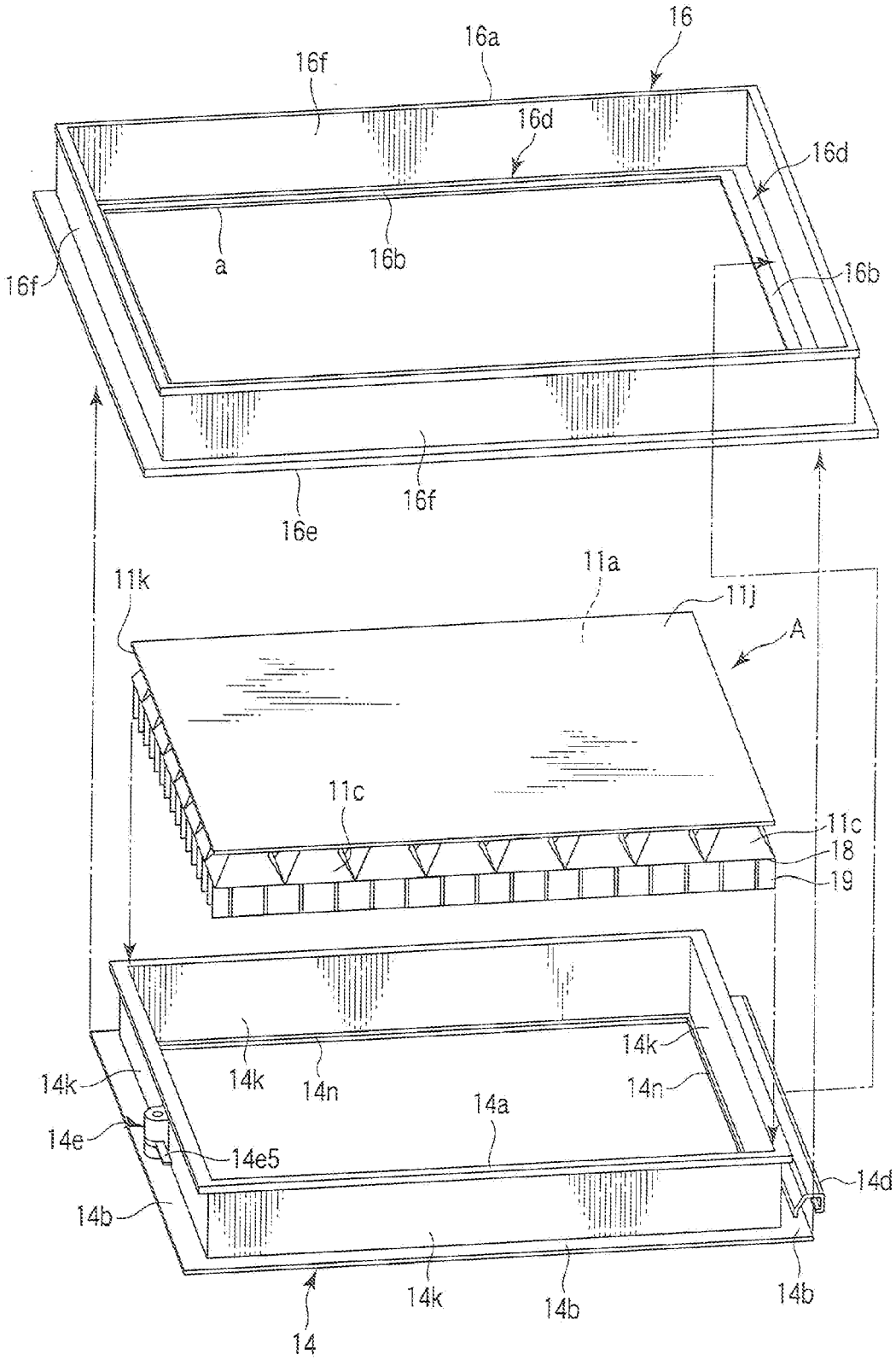
FIG. 7 is an exploded perspective view of the luminaire shown in FIG. 1.
Figure 13:
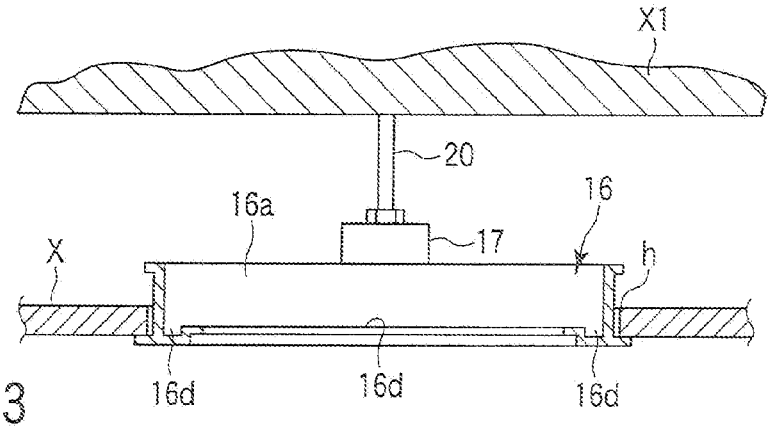
FIG. 13 is a sectional view of the state in which the support frame and lighting unit of the luminaire shown in FIG. 1 are installed on a ceiling.

The support frame 16 is provided in an installation site on a ceiling as shown in FIG. 13. The support frame 16 is made of metal with high heat conductivity, such as aluminum alloy painted white like the main body frame 14, in this embodiment, and is formed in one piece with the square frame body 16*a*. The frame body 16*a* is sized to contain the main body frame 14, as shown in FIG. 1 and FIG. 7. The support frame 16 supports the square equipment main body B comprising the light-emitting unit A and main body frame 14 as shown in FIG. 1.

The support frame 16 has an inner flange 16*b* in the frame body 16*a*, which is formed in one piece of the support frame and extended inward. The distal end portion of the inner flange 16*b* is formed in one piece with a step 16*c*, as shown in FIG. 8. In the step 16*c*, a shallow groove-shaped receiving place 16*d* opening upward is formed in the inner flange 16*b* as shown in FIG. 8. The receiving place 16*d* is formed long in one piece with the frame body 16*a* along at least one side of the frame body. The luminaire 10 of this embodiment has the receiving place 16*d* on every side, or four sides, of the square support frame 16. In the luminaire 10, the outer flange 16*e* extending outward is formed in one piece with the frame body 16*a*. The outer flange 16*e* functions as an ornamental frame when the equipment is installed on a ceiling.

Figure 9:
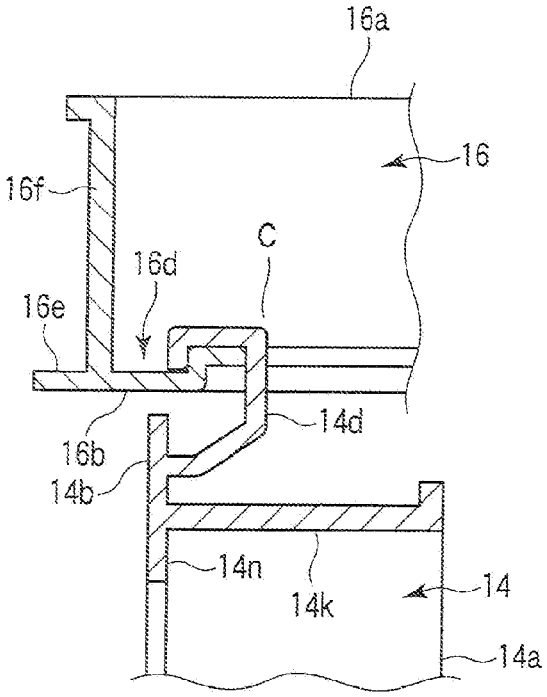
FIG. 9 is a sectional view of the state in which the engaging piece is hooked in the receiving place shown in FIG. 8, and a main body frame is suspended from a support frame.

The groove-shaped receiving place 16*d* engages with the engaging piece 14*d* of the main body frame 14 as shown in FIG. 8. As the engaging piece 14*d* engages with the receiving place 16*d*, the main body frame 14 is swiveled with respect to one side of the support frame 16, just like a hatch is opened and closed. The engaging piece 14*d* and receiving place 16*d* function as a hinge C as shown in FIG. 8, and prevents coming-off of the main body frame 14 from the support frame 16 when the main body frame 14 is released, as shown in FIG. 9.

Figure 11:
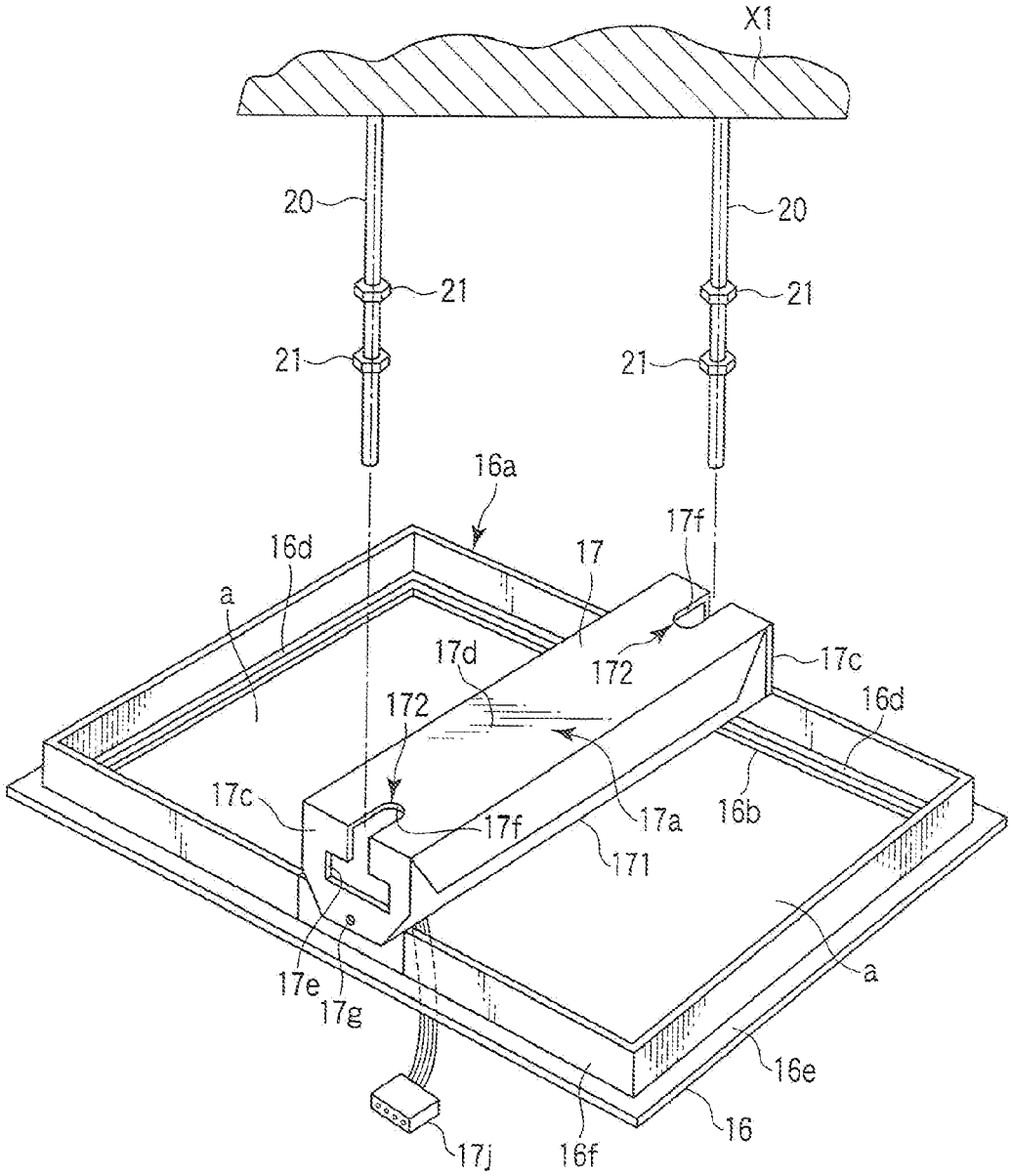
FIG. 11 is a perspective view of the state in which a support frame and a lighting unit of the luminaire shown in FIG. 1 are going to be installed on a ceiling.
Figure 12:
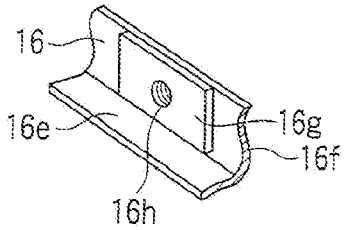
FIG. 12 is a enlarged view of attaching portion of the support frame as shown in FIG. 11.

The support frame 16 and main body frame 14 are shaped square. The receiving place 16*d* is formed on four sides of the support frame 16. Therefore, the engaging piece 14*d* of the main body frame 14 can engage with any receiving place 16 on any side. The support frame 16 has a steel-plate mount piece 16*g* on a pair of opposing side plates 16*f* as shown in FIG. 11. The mount piece 16*g* has a screw hole 16*h* at the center as shown in FIG. 12.

The lighting unit 17 comprises a lighting circuit 171 and a case 17*a*. The lighting circuit 17*a* converts ac 100V into dc 24V, and supplies it to a light-emitting diode chip. The ac voltage and converted dc voltage supplied to the lighting circuit are not limited to the above valves. The voltage values are different in countries and localities where the luminaire 10 is installed, or the conditions of using the luminaire 10.

As shown in FIG. 11, the case 17*a* is made of a steel plate, and is made in the form of a long rectangular parallelepiped reaching the opposing side plates 16*f* of the support frame 16. The lighting circuit 171 is housed in the case 17*a*. The side plates 17*c* formed at both ends of the case 17*a* are continued through a top plate 17*d*. The case 17*a* has a support port 172 cut across the side plate 17*c* and top plate 17*d*. The support port 172 comprises a entering part 17*e* and a hitching part 17*f*. The entering part 17*e* is opened on the side plate 17*c*. The hitching part 17*f* is opened on the top plate 17*d*, and is continued to the entering part 17*e*.

The case 17*a* formed as above is supported by suspension bolts 20 and nuts 21 as shown in FIG. 11 and FIG. 13. The suspension bolts 20 are extended downward from a support member 30 on a ceiling. The nuts 21 are assembled to the suspension bolts 20. The entering part 17*e* is sized to pass the nut 21 attached to the suspension bolt 20. The suspension bolts 20 can pass the hitching part 17*f* inward from outside the side plate 17*c*, while the nuts 21 cannot pass the hitching part 17*f* formed in the side plate 17*c* or the top plate 17*d*.

The side plate 17*c* has a connecting hole 17*g* in the lower part of the entering part 17*e*. The case 17*a* holding the lighting circuit 171 is located across the side plates 16*f* provided on the opposite sides of the support frame 16, as shown in FIG. 11. The connecting hole 17*g* is aligned with a screw hole 16*h* of a mount piece 16*g* attached to the side plate 16*f* of the support frame 16, and is fastened with a screw. The screw hole 17*h* and connecting hole 17*g* may be provided at reverse positions. In other words, a penetrating hole may be provided in the mount piece 16*g*, and a screw hole may be provided in the side plate 17*c*.

Figure 14:
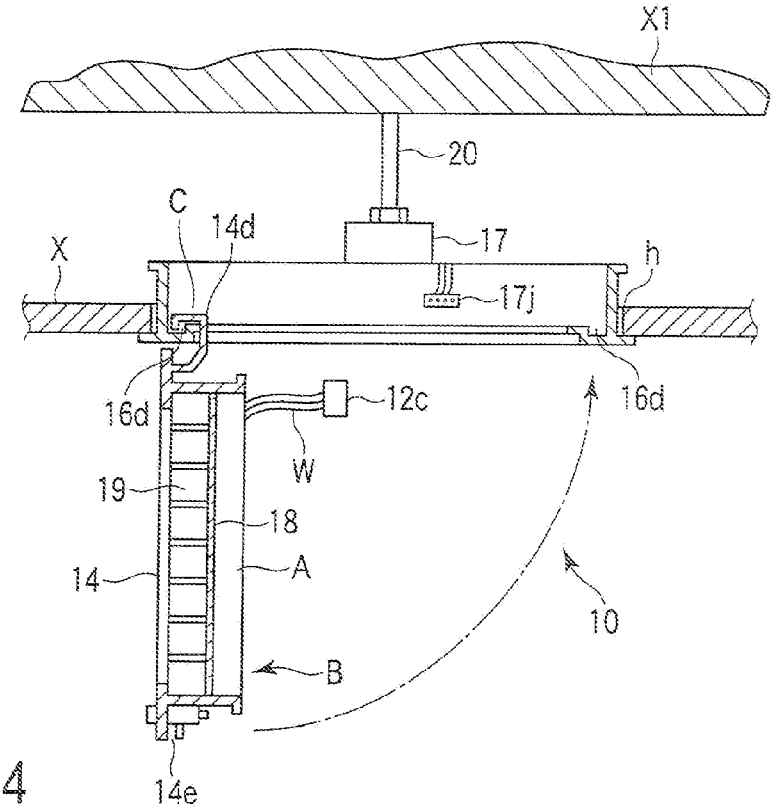
FIG. 14 is a sectional view of the state in which a main body frame having a light-emitting unit is suspended from the support frame shown in FIG. 13.

Further, as shown in FIG. 11, a terminal unit 17*j* connected to the output part of the lighting circuit 171 is led out from one side of the case 17*a*. As shown in FIG. 14, the light-emitting unit A has a connector 12*c* at the distal end of a lead wire 41 connected to the input terminal. The terminal unit 17*j* is connected to the connector 12*c*. As shown in FIG. 14, the terminal unit 17*j* is provided sufficiently long not to receive a tensile force in the state being connected to the connector 12*c*, even if the main body frame 14 is opened to the position suspending from the support frame 16. The lead wire 41 connected to the connector 12*c* may be provided sufficiently long. The case 17*a* may be located so that the side from which the terminal unit 17*j* is led out comes close to the receiving place 16*d* of the support frame 16 connected to the engaging piece 14*d* of the main body frame 14.

Figure 15:
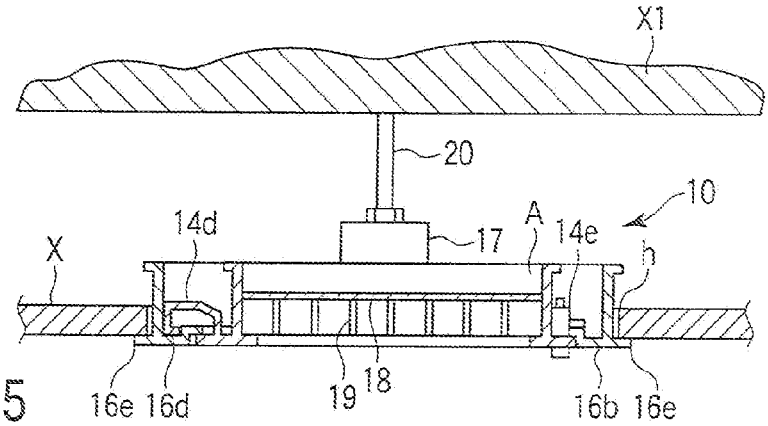
FIG. 15 is a sectional view of the state in which the main body frame shown in FIG. 14 is housed in the support frame.

As described above, the luminaire 10 comprising a light-emitting unit A, a main body frame 14, a support frame 16, and a lighting unit 17 is installed on a ceiling X that is an installation place in the procedures shown in FIG. 13 to FIG. 15. The ceiling X has a square hole h that is previously opened to the size to allow insertion of the support frame 16. Two suspension bolts 20 are provided in the support member 30 on the backside of the ceiling. These suspension bolts 20 are prepared at the positions corresponding to the support ports 172 formed in the case 17*a* of the lighting unit 17. Each suspension bolt 20 has two nuts 21 as shown in FIG. 11.

First, as shown in FIG. 11, the lighting unit 17 is mounted on the support frame 16. Then, as shown in FIG. 13, the support frame 16 combined with the lighting unit 17 is installed in the hole h on the ceiling X with the case 17*a* faced up. In the case 17*a* inserted into the ceiling X, the nut 21 of the corresponding suspension bolt 20 is inserted into the entering part 17*e* of the support port 172. At this time, the lower nut 21 of two nuts 21 is inserted into the support port 172 through the entering part 17*e*. The suspension bolt 20 is inserted into the hitching part 17*f* from the outside of the side plate 17*c* of the case 17*a*. The upper nut 21 is previously screwed at a sufficiently high position to be positioned above the top plate 17*d* of the case 17*a*. When the other suspension bolt 20 is inserted into the corresponding support port 172 of the case 17*a*, one of the suspension bolts 20 is curved, and the lower nut 21 is inserted through the entering part 17*e*. The suspension bolt 20 is inserted into the support port 172 through the hitching part 17*f*.

After the suspension bolt 20 is inserted into the support port 172, the support frame 16 is adjusted to the hole h. At this time, the installation position is adjusted by sliding the support frame 16 to the suspension bolt 20 in the range of the hung-up part 17*f* of the case 17*a*, so that the jagged inner inside edge of the hole h is hidden by the outer flange 16*e*, which becomes an ornamental frame of the support frame 16. As a result, the installation position of the support frame 16 to the ceiling X is determined. After the installation position of the support frame 16 is determined, two nuts 21 of each suspension bolt 20 are tightened so as to hold the case 17*a* from the upper and lower sides. As a result, the case 17*a* is secured to two suspension bolts 20. In the above procedure, the support frame 16 is supported by the support member 30 on the backside of the ceiling through the case 17*a* of the lighting unit 17, as shown in FIG. 13.

The lighting unit 17 is attached across two sides of the support frame 16, crossing over the frame body a. Therefore, as shown in FIG. 11, the side of the lighting unit 17 not connected to the support frame 16 forms an opening a leading to the backside of the ceiling. The operation of installing the support frame 16 on the ceiling X can be done while visually checking the conditions of the backside of the ceiling or the states of the suspension bolts 20 and nuts 21, through the opening a. A series of operation of securing the support frame 16 to the ceiling X is performed in the state in which the equipment main body B combined with the light-emitting unit A and main body frame 14 is not being assembled to the support frame 16. The support frame 16 is made of light material such as aluminum and synthetic resin, and can be easily held up when installing.

Next, the main body frame 14 is raised, and the engaging piece 14*d* is engaged with the receiving place 16*d* of the support frame 16. As the receiving place 16*d* is formed on four sides of the square support frame 16, the engaging piece 14*d* of the main body frame 14 can engage with any lock mount 16*d*. Therefore, it is possible to engage appropriate engaging piece 14*d* with suitable receiving place 16*d*, according to conditions such as obstacles around the ceiling X. As described above, the main body frame 14 is suspended from one side of the support frame 16. The light control unit 19, transmissive plate 18, and light-emitting unit A are inserted in this order into the frame body 14*a* of the suspended main body frame 14, and held by a holding member. As a result, the light-emitting unit A is assembled in one piece with the main body frame 14 as shown in FIG. 14.

The terminal unit 17*j* led out from one side of the case 17*a* of the lighting unit 17 is connected to the connector 12*c* attached to the distal end of the lead wire 41 of the light-emitting unit A. When the wiring of the lighting unit 17 and light-emitting unit A is done close to the hinge C, the lead wire 41 of the light-emitting unit A can be educed. The wire connecting operation can be done while the main body frame 14 is being suspended from the support frame 16, and improving the workability.

The hinge C is constructed by engaging the engaging piece 14*d* with the receiving place 16*d*. The main body frame 14 is rotationally moved about the hinge C, the center of axis, in the direction of pushing up the hinge C as indicated by the arrow in FIG. 14, and closes the opening of the support frame 16 so as to fit the main body frame 14 in the support frame 16.

The main body frame 14 makes the engagement unit 14*e* provided on the side opposite to the hinge C contact with the flange 16*b* of the support frame 16. As shown in FIG. 2 and FIG. 3, when the screw head 14*e*3 of the stopper 14*e*1 exposed to the surface of the main body frame 14 is turned to the left or right by using a specialized tool, the stopper piece 14*e*5 separates from the side plate 14*k* of the main body frame 14, and engages with the inner flange 16*b*. Namely, the main body frame 14 is assembled to the support frame 16, when one side engages with the engaging piece 14*d* and receiving place 16*d*, and the other side engages with the engagement unit 14*e*.

The projection 19*e*4 of the lock mechanism 141 fits in the recess 14*e*6 of the bearing 14*e*2 and the rotational movement of the stopper 14*e*1 is limited as shown in FIG. 3, when the stopper piece 14*e*5 engages with the inner flange 16*b* as shown in FIG. 2. The stopper 14*e*5 is not loosened by vibration even if the engagement unit 14*e* is used for a long period. Therefore, the engagement unit 14*e* is not disengaged from the inside of the inner flange 16*b* of the support frame 16. The equipment main body B is securely jointed to the support frame 16, and prevented from coming off, and the safety is secured. The luminaire 10 comprising the light-emitting unit A, main body frame 14, support frame 16 and lighting unit is installed on the ceiling X in the above procedures.

The edge of the opening on the ceiling X is covered by the outer flange 162 of the support frame 16 as shown in FIG. 13 to FIG. 15. The outer flange 16*e* of the support frame 16 and the outer flange 14*b* and inner flange 14*n* of the main body frame 19 are arranged on the same level, and flatly installed on the ceiling X, providing good appearance. When the luminaire 10 is lit, the light-emitting elements 11 of the light-emitting unit A are lit white. The light emitted from the light-emitting elements spreads downward and sideways. This light is reflected on the reflection surface 11*h* of the reflector 11*c*, lighting a wide circular area around the luminaire, as well as the area immediately below the luminaire. Further, a part of the light reflected on the reflection surface 11*h* is emitted to the sideways of the luminaire 10, lighting a wide area on the ceiling X.

The heat generated from the light-emitting elements 11 during lighting of the luminaire 10 is radiated from the base substrate 11*a* to the outside through the steel-plate radiator 11*j*. The heat from the lighting unit 17 is radiated through the steel-plate case 17*a* and aluminum support frame 16. This prevents lowering of the light-emitting efficiency of the light-emitting diodes constituting the light-emitting elements 11. In other words, the luminaire 10 can prevent lowering of light flux accompanying with a temperature increase. The service life of the light-emitting diodes is increased, and the reliability of the circuit components of the light-emitting unit 17 is improved.

The light-emitting unit A is removed in the following procedures, when the light-emitting unit A is removed for maintenance of the light-emitting elements 11 as a light source or other parts. First, as shown in FIG. 2 and FIG. 3, the screw head 14*e*3 of the stopper 14*e*1 is turned to the left or right by using a specialized tool. The resin-made bearing 14*e*2 is bent by elasticity, and the projection 14*e*4 is disengaged from the recess 14*e*6 of the bearing 14*e*2, and the lock is released. The turning of the stopper 14*e*1 releases the engagement between the stopper piece 14*e*5 and inner flange 16*b* and the engagement between the projection 14*e*4 and recess 14*e*6 of the lock mechanism.

When the engagements are completely released, the main body frame 14 is rotationally moved about the center of axis of the hinge C, in the direction reverse to the arrow shown in FIG. 14 from the support frame 15. FIG. 8 shows the cross section of the hinge C in the state in which the main body frame 14 closes the opening a of the support frame 16. FIG. 9 shows the cross section of the hinge C in the state in which the main body frame 14 opens the opening a of the support frame 16. When the main body frame 14 is opened, the engaging piece 14*d* engages with the receiving place 16*d* as shown in FIG. 9, the main body frame 14 is suspended in being opened without coming off the support frame 16 as shown in FIG. 14.

Figure 10:
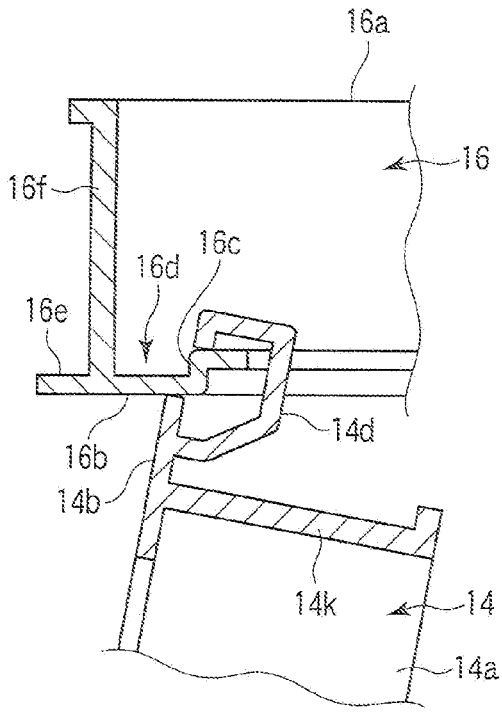
FIG. 10 is a sectional view of the state in which the engaging piece is removed from the receiving place shown in FIG. 9.

First the holding member is removed, and the light-emitting unit A is removed from the main body frame 14, when the light-emitting unit A is removed from the main body frame 14 in the state in which the main body frame 14 is being suspended from the support frame 16. When the light-emitting unit A is removed together with the main body frame 14, the main body frame 14 is turned farther from the state shown in FIG. 9 in the opening direction as shown in FIG. 10, and the engaging piece 14*d* is disengaged from the receiving place 16*d*. The light-emitting unit A can be replaced in a stable place after once removing together with the main body frame 14, when only the light-emitting unit A is replaced. Therefore, the high-place operation can be reduced, when the luminaire 10 is installed on a high ceiling such as the ceiling in a hall, a dome, a stadium, and a theater.

Further, when the luminaire 10 is replaced, first the equipment main body B is removed from the ceiling X as described above, and then the support frame 16 and lighting unit 17 are removed from the ceiling X in the procedures reverse to the installation. In particular, the nuts 21 of the suspension bolts 20 are loosen, one of the suspension bolts 20 is curved, and slid from the hitching part 17*f* to entering part 17*e* of the case 17*a*. One of the suspension bolts 20 is removed from the case 17*a* by passing the nut 21 through the entering part 17*e*. The case 17*a* is slid for the other suspension bolt 20, after the one of the suspension bolts 20 is removed. The nut 21 is through the entering part 17*e*, and the other suspension bolt 20 is removed from the hitching part 17*f*. The lighting unit 17 can be removed together with the support frame 16 in being attached to the support frame. The operation of removing the support frame 16 and lighting unit 17 can be performed while monitoring the states of the suspension bolts 20 and nuts 21 through the opening a of the support frame 16.

As described above, according to this embodiment, the luminaire 10 comprises the main body frame 14 to house the light-emitting unit A, and the support frame 16 to hold the main body frame on a ceiling, which are formed as separate disassembling parts. The main body frame 14 has a hook-shaped engaging piece 14*d* on one side of the square frame body 14*a* shaped. The support frame 16 has a groove-shaped receiving place 16*d* to engage with the engaging piece 14*d* on each side of the square frame body 16*a*. First, only the support frame 16 is installed on the ceiling X, and then the main body frame 14 combined with the light-emitting unit A is installed, when the luminaire 10 is installed. The installation operation can be performed while monitoring the situation of the backside of the ceiling and the states of the suspension bolts 20 and nuts 21 through the opening a of the support frame 16. The main body frame 14 and support frame 16 can be separately installed. Hence the installation operation is light and easy.

The main body frame 14 is jointed to the support frame 16 by engaging the engaging piece 14*d* with the receiving place 16*d* of the previously installed support frame 16. The light-emitting unit A can be installed in the main body frame 14 being suspended from the support frame 16. As described above, when the luminaire 10 is installed on a ceiling, first the support frame 16 made of light material such as synthetic resin or light metal such as aluminum is installed, and then equipment main body B combined with the light-emitting unit A and main body frame 14 is installed. In a conventional luminaire formed in one piece, a relatively light part such as a lighting unit must be supported until a luminaire is completely installed and suspended from a ceiling.

The luminaire 10 of this embodiment facilitates installation on an installation site such as a ceiling. In particular, the luminaire 10 adopting a light-emitting diode as a light source is light in weight and excellent in workability in installation.

Further, the support frame 16 has a receiving place 16*d* on four sides of the square frame body 16*a*, as shown in FIG. 11 and FIG. 13. Therefore the main body frame 14 can engage the engaging piece 14*d* with any receiving place 16*d* on any side. It is possible to select suitable engaging piece 14*d* and receiving place 16*d*, by checking whether the main body frame 14 can be opened and closed with respect to the support frame 16, or watching situation, or obstacles near the ceiling. On the occasion of maintenance of the luminaire 10 after the equipment is once installed, the main body frame 14 is removed from the support frame 16. It is possible to avoid contacting of the light-emitting unit A with an obstacle near the ceiling X by checking before installation.

The engaging piece 14*d* and receiving place 16*d* are shaped long along one side of the frame body 14*a* and 16*a* of the main body frame 14 and support frame 16 as shown in FIG. 7. As the engaging piece 14*d* engages with the receiving place 16*d* in a wide area, the mechanism of the hinge C is stabilized, and the operability is improved in rotationally moving the main body frame 14. As the engaging piece 14*d* and receiving place 16*d* are provided over the entire length of one side of the frame bodies 14*a* and 16*a*, clearance between the main body frame 14 and support frame 16 is negligible. This improves the appearance of the luminaire 10.

The case 17*a* of the lighting unit 17 is attached to the support frame 16 as shown in FIG. 11. In the luminaire 10, the installation operation is simplified, since the lighting unit 17 can be installed simultaneously when the support frame 16 is installed on the ceiling X. When the terminal unit 17*j* of the lighting unit 17 is provided close to the groove-shaped receiving place 16*d* of the support frame 16, that is the hinge C, it is shortened the wiring length of the lead wire 41 connecting the lighting unit 17 and light-emitting unit A. Since the lead wire 41 is wired in a minimum necessary length on the rear side of the light-emitting unit A, the lead wire 41 does not disturb the installation and maintenance of the luminaire 10. This facilitates the installation and maintenance. In addition, as the length of the lead wire 41 is reduced, a risk of breaking the wire is decreased. As the necessary length of the lead wire is reduced, the material cost can be decreased, reducing the total costs.

In the luminaire 10 of this embodiment as shown in FIG. 13 through FIG. 15, the case 17*a* assembled with the lighting circuit 171 is supported by the suspension bolts 20. As the luminaire 10 is installed in an installation site on the backside of the ceiling X, the luminaire 10 is securely and rigidly supported compared with a conventional luminaire which is secured to a ceiling panel by the elasticity of a leaf spring. Therefore, the size of the luminaire 10 can be increased. In this case, the supporting structure has a support port 172 cut across the side plates 17*c* at both ends of the case 17*a* and the top plate 17*d*. As the support port 172 is provided at a corner with high rigidity, the case 17*a* is prevented from unnecessary deformation. The support port 172 includes a entering part 17*e* and a hitching part 17*f*, which are secured to suspension bolt 20 with nut 21. The entering part 17 is sized to allow insertion of the nut 21 of the suspension bolt 20. The hitching part 17*f* is sized to permit insertion of the suspension bolt 20, but not to permit insertion of the nut 21. The nut 21 secured to the suspension bolt 20 is inserted into the hitching part 17*f* through the entering part 17*e*. The suspension bolt and case 17*a* can be engaged and supported by simple sliding operation, improving the workability.

The case 17*a* is supported across the support frame 16. An opening a is formed on both sides of the lighting unit 17. The states of the suspension bolt 20 and nut 21 can be checked and adjusted through the opening a by inserting a hand.

Further, the luminaire 10 is provided with the engagement unit 14*e* in the main body frame 14 opposite to the hinge C as shown in FIG. 14 and FIG. 15. The engagement unit 14*e* engages with the inner flange 16*b* of the support frame 16 by rotating the stopper piece 14*e*5. The stopper 14*e*1 can be operated simply by turning the screw head 14*e*3 exposed to the surface of the main body frame 14 by about 90°. This eliminates tedious conventional work of turning small screws many times. Even if the luminaire 10 is installed in a high place or dark place, the workability of specialized tool is not extremely decreased.

The engagement unit 14*e* has a lock mechanism 141 which shown in FIG. 3. The lock mechanism 141 securely controls the rotation of the stopper piece 14*e*5. As the lock mechanism 141 is provided, the stopper piece 14*e*5 is not loosened by vibration or long-time use, and the engagement with the support frame 16 is not released. The main body frame 14 holding the light-emitting unit A is fixed to the support frame 16 by the engagement unit 14*e*. The light-emitting unit A uses a small light-emitting diode as a light source, and the weight of the whole unit is decreased.

The engagement unit 14*e* shown in FIG. 2 and FIG. 3 is provided in one piece with the main body frame 14, and comprises a bearing 14*e*2, and a metallic stopper 14*e*1 fit to the bearing 14*e*2. The engagement unit 14*e* is very simple in structure, and low in cost. The lock mechanism 141 has a simple structure comprising a projection 14*e*4 formed in the metallic stopper 14*e*1, and a recess 14*e*6 formed in the bearing 14*e*2. The locking operation can be done simultaneously with the rotational movement of the stopper 14*e*1. Any special operation is unnecessary for locking, and the operability is maintained. The bearing 14*e*2 is formed in one piece with the main body frame 14 made of light material such as synthetic resin and aluminum. The bearing 14*e*2 is configured to engage the projection 14*e*4 in the recess 14*e*6 by the elastic force. The lock mechanism 141 needs not to use any specific elastic member such as a spring, and is very simple in structure, and low in cost. The lock mechanism is unlocked simultaneously with disengagement of the engagement unit 14*e*, when the equipment main body B is removed from the support frame 16. The luminaire 10 needs any releasing operation for unlocking the lock mechanism 141, and the operability is excellent.

In the luminaire 10 of this embodiment, the receiving place 16*d* of the support frame 16 is provided on all of four sides of the frame body 16*a* as shown in FIG. 11 and FIG. 13. The receiving place 16*d* may be provided to lock the engaging piece 14*d* of the main body frame 14, and to make the main body frame 14 rotationally movable with respect to the support frame 16. Therefore, the receiving place may be provided only on the side opposing the side provided with the engagement unit 14*e*. In this embodiment, the receiving place 16*d* and engaging piece 14*d* are formed over the entire length of the sides of the frame body 14*a* and 16*a*. One or both of the engaging piece 14*d* and receiving place 16*d* may be shorter than the side of the frame body, as long as the function of suspending the main body frame 14 combined with the light-emitting unit A is ensured.

Figure 16:
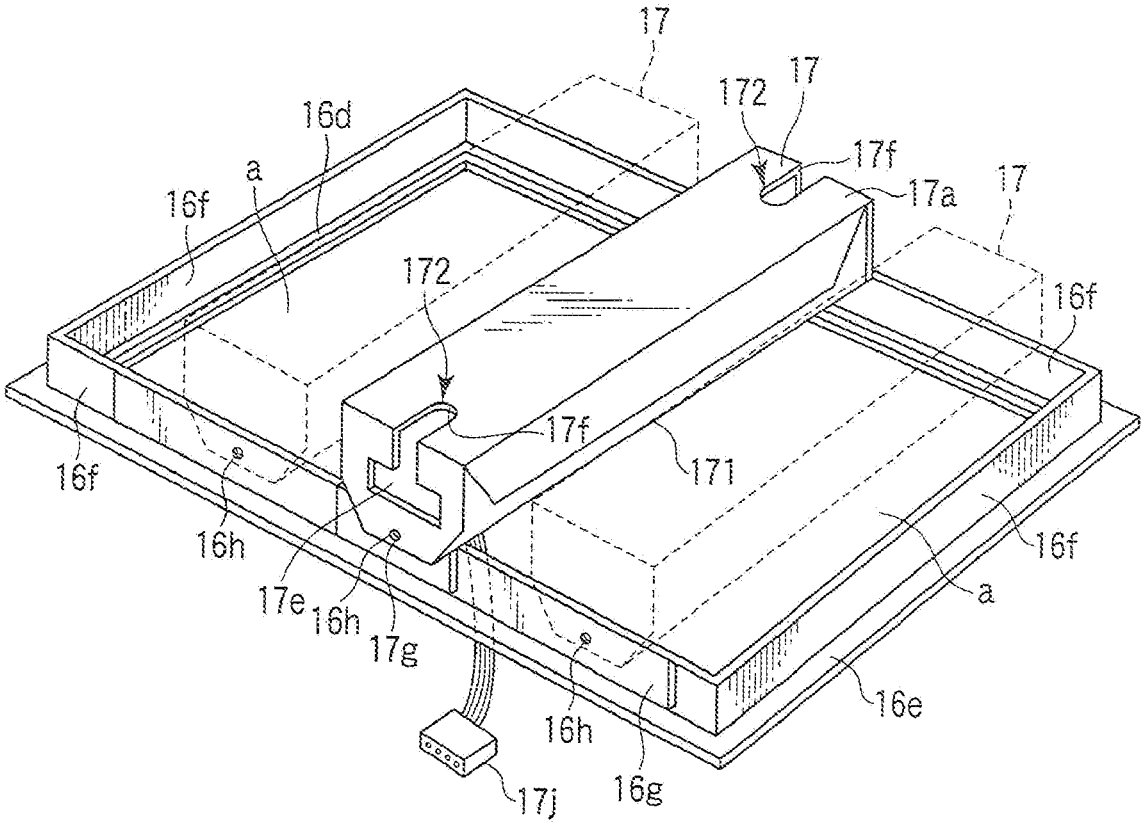
FIG. 16 is a perspective view of a modification of a support frame of the luminaire shown in FIG. 1.

The plurality of the screw hole 16*h* of the mount piece 16*g* attached to the side plate 16*f* located on the opposing side of the support frame 16 are provided, three screw holes 16*h* are provided in this embodiment, as shown in FIG. 16, for assembling the case 17*a* of the lighting unit 17 to the support frame 16. The screw holes 16*h* are arranged at regular intervals, and the screw holes 16*h* on the opposing sides are used in pair.

One of the three pairs of screw holes 16*h* may be selected, and the position to secure the case 17*a* to the support frame 16 may be selected.

For example, the screw hole 16*h* is chosen to assemble the lighting unit 17 at the position indicated by a broken line in FIG. 15 to avoid any structure such as a C-shaped channel, which is extending on the backside of ceiling and interferes with the lighting unit 17. A long hole may be provided instead of the screw hole 16*h*, to permit selection of a desired position in the long continuously hole. In this case, a screw hole is formed in a connecting hole 17*g* provided on the side plate 17*c* of the case 17*a*.

Figure 17:
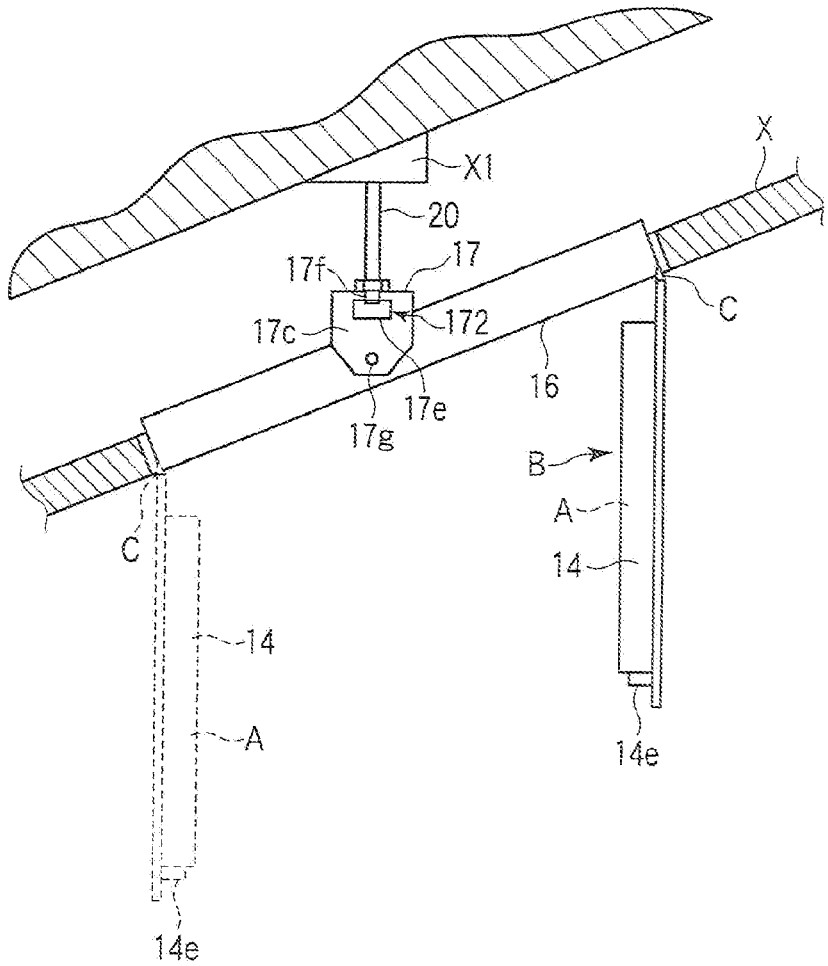
FIG. 17 is a side view of the state in which a support frame of the luminaire shown in FIG. 1 is installed on an inclined ceiling.

Further, as shown in FIG. 17, the luminaire 10 may be installed on the inclined ceiling X. In this case, the side plate 17*c* of the case 17*a* is assembled rotationally movable with respect to the mount piece 16*g* of the support frame 16. As shown in FIG. 17, the case 17*a* of the lighting unit 17 is suspended flatly in the direction along the level line such as the inclined surface, with respect to the suspension bolt 20 extended from the support member X1 provided on the inclined ceiling X. The support frame 16 is assembled obliquely to meet the inclination of the ceiling X with the connecting hole 17*g* taken as a center.

In this case, the hinge C supporting the main body frame 14 rotationally movable with respect to the support frame 16 is provided on the higher side or lower side of the inclination of the ceiling X as shown in FIG. 17. If the hinge C is located with its axis of center along the direction going down the inclined surface, the main body frame 14 is partly opened, and the installation operation becomes difficult. In this embodiment, the receiving place 16*d* of the support frame 16 is provided on all of four sides of the frame body 16*a*. Therefore, even if the ceiling X is inclined, the receiving place 16*d* can be easily selected so that the hinge C is located on the higher side or lower side of the inclination.

The engagement unit 14*e* is not limited to the rotationally movable mechanism shown in FIG. 2 and FIG. 3. The engagement unit 14*e* may engage the main body frame 14 with the support frame 16 installed on the ceiling X, and may comprise a stopper piece 14*e*5 and a lock mechanism 141. In this case, the stopper piece 14*e*5 moves relatively to the main body frame 14 and support frame 16, and engages them. The lock mechanism 141 holds the stopper piece 14*e*5 at the position to engage the main body frame 14 with the support frame 16.

Figure 18:
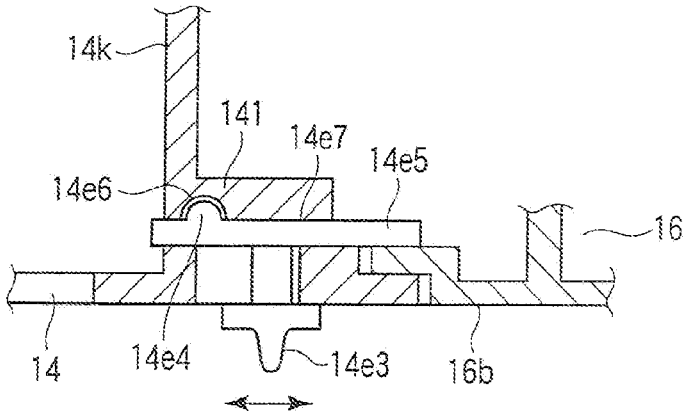
FIG. 18 is a sectional view of a first modification of the engagement unit shown in FIG. 2.

The stopper piece 14*e*5 may slide, and engage the main body frame 14 with the support frame 16 as shown in FIG. 18. FIG. 18 shows a first modification of the engagement unit 14*e*. The stopper piece 14*e*5 of the stopper 14*e*1 consists of a slidable piece made of metal or synthetic resin. The stopper piece 14*e*5 is slidably inserted into the guide hole 14*e*7 formed in the side plate 14*k* of the main body frame 14. The stopper piece 14*e*5 is moved by a knob 14*e*3' exposed to the surface of the main body frame 14. FIG. 18 shows the state in which the stopper piece 14*e*5 is being engaged with the inner flange 16*b*. In this case, the lock mechanism 141 is constructed by engaging the projection 14*e*4 of the stopper piece 14*e*5 in the recess 1426 formed inside the guide hole 14*e*7.

Figure 19:
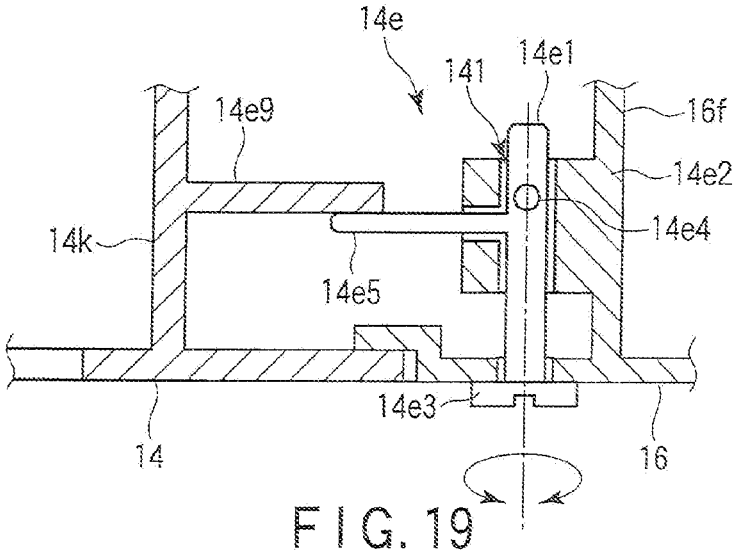
FIG. 19 is a sectional view of a second modification of the engagement unit shown in FIG. 2.

Further, the engagement unit 14*e* may be provided in the support frame 16 as shown in FIG. 19. FIG. 19 shows a second modification of the engagement unit 14*e*. The bearing 14*e*2 is formed in one piece with the side plate 16*f* of the support frame 16. The stopper piece 14*e*2 is extended perpendicularly from the stopper 14*e*1 fit to the bearing 14*e*2, and engages with the projection 14*e*9 formed in one piece in the direction of extending outward from the side plate 14*k* of the main body frame 14, just like supporting from the lower side. The lock mechanism 141 has the same structure as that shown in FIG. 2 and FIG. 3.

Figure 20:
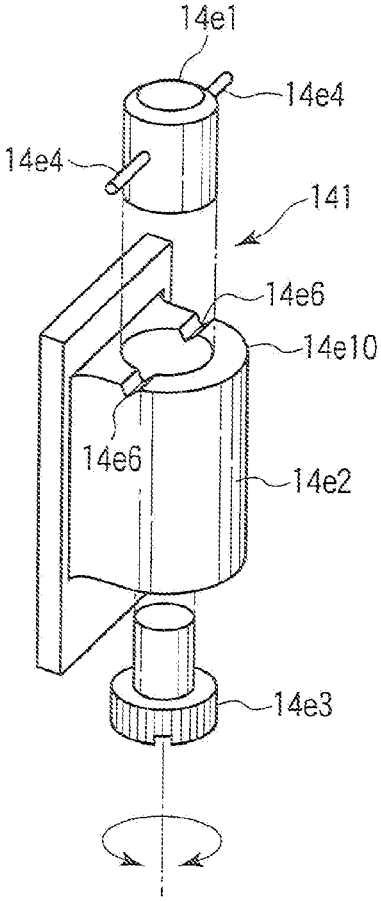
FIG. 20 is a perspective view of a first modification of a lock mechanism of the engagement unit shown in FIG. 2.

The lock mechanism 141 may have a projection 14*e*4 and a recess 14*e*6 as shown in FIG. 20. FIG. 20 shows a first modification of the lock mechanism 141. The projection 14*e*4 consists of both ends of a pin penetrating the distal end of the stopper 14*e*1 inserted into the bearing 14*e*2 in the diametrical direction. The recess 14*e*6 consists of a pair of grooves formed at the end portion 14*e*10 of opening of the bearing 14*e*2. When the projection 14*e*4 fits in the recess 14*e*6, the stopper piece 14*e*5 engages the main body frame 14 with the support frame 16.

In the lock mechanism 141 of this embodiment, the projection 14*e*4 is formed in the metallic stopper 14*e*1, and the recess 14*e*6 is formed in the bearing 14*e*2 by opening a small hole. The small hole or groove-shaped recess 14*e*6 may be formed in the metallic stopper 14*e*1 or a slidable piece 14*e*5', and the projection 14*e*4 may be formed inside the bearing 14*e*2 or guide hole 14*e*7. The lock mechanism 141 is configured to engage/disengage the projection 14*e*4 with/from the recess 14*e*6 by the elasticity of the member itself.

When the bearing 14*e*2 and stopper 14*e*1 are made of metal, the projection 14*e*4 formed in the stopper 14*e*1 consists of a metallic ball. The ball is always energized in a projecting direction by a coil spring, and is configured to engage/disengage with/from the recess 14*e*6 of the bearing 14*e*2. The lock mechanism 141 secures engagement/disengagement, and clicks when engaging. Therefore, a slidable and highly operable engagement unit can be constructed.

Figure 21:
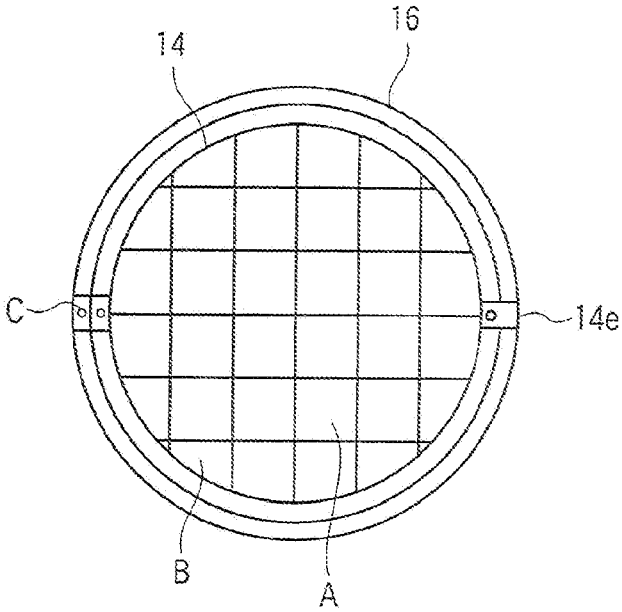
FIG. 21 is a front view of a first modification of the luminaire shown in FIG. 1.

In the above description, the equipment main body B is square, and comprises the light-emitting unit A and main body frame 14, and the support frame 16 supporting the equipment main body. The front side shape of the luminaire 10 may be circular as shown in FIG. 21. In this case, the hinge C is provided in one end portion of the diameter of a circular light-emitting unit A, and the engagement unit 14*e* is provided in the other end portion.

A luminaire 10 according to a second embodiment of the invention will be explained with reference to FIG. 22 to FIG. 36. The components having the same functions as those of the first embodiment are denoted by the same reference numbers in the drawings, and an explanation thereof is omitted.

Figure 22:
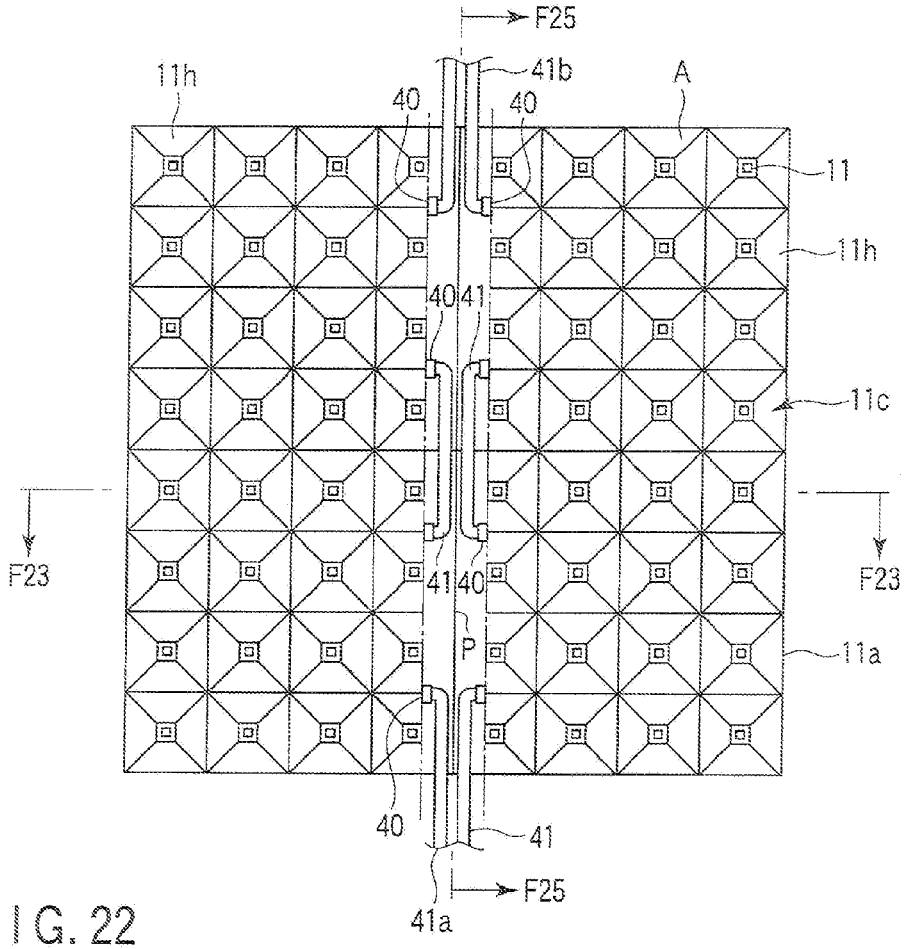
FIG. 22 is a front view of a light-emitting unit provided in a luminaire according to a second embodiment of the invention, with a part of a reflector broken away.

As shown in FIG. 22, the luminaire 10 is a recessed ceiling type, and adopts a light-emitting unit A made in the form of a rectangular flat plate. In this embodiment, the light-emitting unit A is shaped square. The light-emitting unit A comprises a base substrate 11*a*, a reflector 11*c*, a connector 40, and a lead wire 41. On the base substrate 11*a*, light-emitting elements 11 mounted in square. The reflector 11*c* is attached on the side of the base substrate 11*a* provided with the light-emitting elements 11, and has a reflection surface 11*h* surrounding each light-emitting element 11. The connector 40 is mounted on the base substrate 11*a*. The connector 40 is a terminal connected to the light-emitting element 11. The lead wire 41 is connected to the connector 40.

Figure 23:
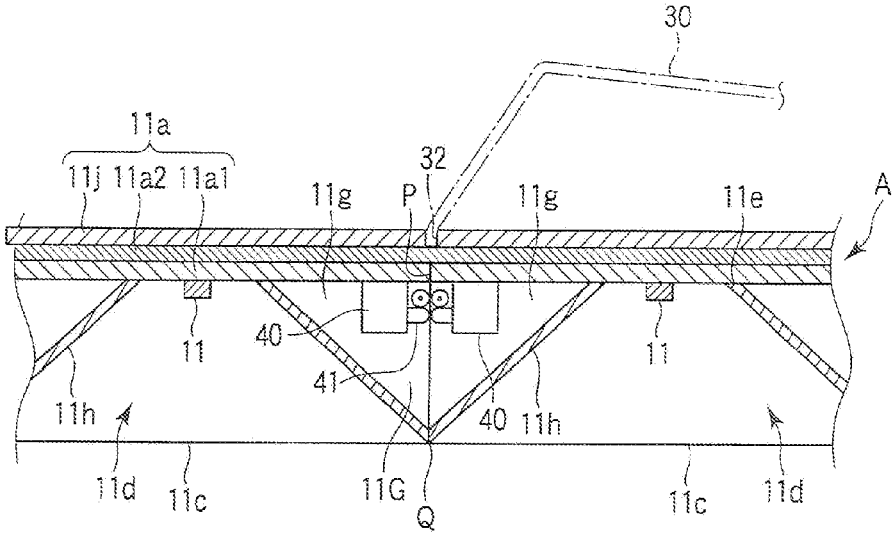
FIG. 23 is a sectional view of a light-emitting unit along the line F23-F23 in FIG. 22.
Figure 25:
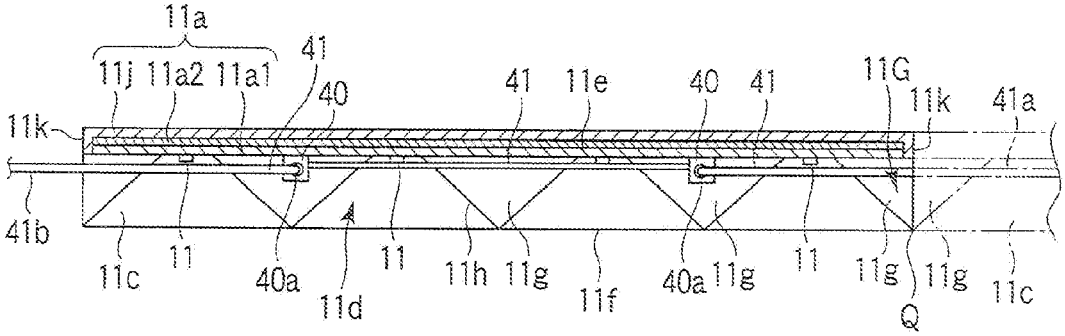
FIG. 25 is a sectional view of the light-emitting unit along the line F25-F25 in FIG. 22.

As shown in FIG. 23 and FIG. 25, the base substrate 11*a* comprises four square circuit boards 11*a*1, a radiator plate 11*j*, and an electrical insulating plate 11*a*2. Each circuit board 11*a*1 is composed of a member to mount the light-emitting element 11 including a light-emitting diode chip, for example, glass epoxy or aluminum substrate. Each circuit board 11*a*1 is a square plate. As shown in FIG. 22, the light-emitting element 11 is arranged in a 4-row by 4-column matrix, 16 in total, on the front surface of the circuit board 11*a*1. A copper foil wiring pattern is formed on the rear surface of the circuit board 11*a*1, corresponding to the arrangement of the light-emitting element 11. In the light-emitting unit A shown in FIG. 22, tour pieces of the above circuit board 11*a*1 are combined.

The radiator plate 11*j* is made of metal with high heat conductivity, such as a steel plate and aluminum. In this embodiment, the radiator plate 11*j* is made of a steel plate. The radiator plate 11*j* is formed in size equivalent to two or more circuit boards 11*a*1 arranged along the same plane. In this embodiment, the radiator plate 11*j* is formed in square of the size equivalent to four circuit boards 11*a*1 arranged in square. The radiator 11*j* has a brim 11*k* formed by raising the parts opposing to the sides of the circuit board 11*a*1 in one piece.

The electrical insulating plate 11*a*2 is inserted between the circuit board 11*a*1 and radiator plate 11*j*. The electrical insulating plate 11*a*2 is a film-like insulating sheet made of heat-resistant insulating silicon resin or epoxy resin. The electrical insulating plate 11*a*2 is shaped square to be fit inside the brim 11*k* of the radiator plate 11*j*.

The reflector 11*c* is arranged on the front surface of four circuit boards 11*a*1 provided with the light-emitting elements 11. Four reflectors 11*c* have the same optical design to have desired light distribution. The reflector 11*c* is made of heat-resistant weather-resistant insulating synthetic resin in the form of a square part having the same dimensions as the circuit board 11*a*1. In this embodiment, the reflector 11*c* is made of white polybutylene terephthalate (PBT).

The reflector 11*c* has a square pyramid concave portion 11*d* corresponding to the number of light-emitting elements 11, and is formed like a so-called waffle. In other words, conical-shaped or funnel-shaped concave portions 11*d* are arranged corresponding to the light-emitting elements 11, as shown in the cross section of FIG. 23. The bottom of each concave portion lid has an opening 11*e*. The light-emitting element 11 is arranged at the center of the opening 11*e*. The reflectors 11*c* are combined so that the bottom of the concave portion lid closely contacts the surface of the circuit board 11*a*1.

A part corresponding to the upper contour of the concave portion 11*d* forms a square exit port 11*f* to emit the light from the light-emitting element 11 to the outside. The reflector 11*c* comprises sixteen concave portions 11*d* made of polybutylene terephthalate (PBT) and formed in one piece correspond to each light-emitting element 11 of one circuit board 11*a*1. Each concave portion 11*d* is formed surrounding the light-emitting element 11. The inside surface of the concave portion 11*d* forms a reflection surface 11*h* as shown in FIG. 23. To obtain light distribution rotationally symmetric with respect to the center axis of the light-emitting element 11, each concave portion 11*d* of the reflector 11*c* is made in the form of a conical having a square cross section along the plane parallel to the circuit board 11*a*1. The reflection surface 11*h* covers the area surrounding the light-emitting element 11, and extends to the square exit port 11*f*. The reflection surface 11*h* may be mirror finished by evaporating or plating aluminum or silver.

The wall forming the reflection surface 11*h* is made to have substantially the same thickness in any portion as shown in FIG. 23. Therefore, when viewed from the rear side, the reflector 11*c* is seemed to have an array of pyramid-shaped projections. The reflector 11*c* and circuit board 11*a*1 are layered, forming a cavity 11*g* having a isosceles triangle vertical cross section between the continuous pyramids. The cavity 11*g* is made in the form of lattice parallel to the outer peripheral sides of the reflector 11*c* and base substrate 11*a*.

As shown in FIG. 22, a larger square light-emitting unit A is formed by combining four pieces of light-emitting unit A, which comprises a circuit board 11*a*1 having sixteen light-emitting elements 11, and a reflector 11*c* having sixteen corresponding reflection surfaces 11*h*. In this embodiment, as shown in FIG. 22, the circuit board 11*a*1 and reflector lie are arranged in 2-row and 2-column, four pieces in total, on the radiator plate 11*j*.

Four pieces of electrical insulating plate 11*a*2 and circuit board 11*a*1 are positioned by the brim 11*k* and mounted on the radiator plate 11*j*. Four reflectors 11*c*1 are arranged on the exit side of the circuit board 11*a*1, and fixed to the circuit board 11*a*1 with a screw from the rear side of the radiator plate 11*j*. The circuit board 11*a*1 and reflector 11*c* may be bonded by heat-resistant insulating adhesive, such as silicon resin and epoxy resin.

Sixteen light-emitting elements 11 are connected in series according to a wiring pattern one the rear side of the circuit board 11*a*1. Four circuit boards 11*a*1 are connected in series by the lead wire 41 as shown in FIG. 22. As a result, sixteen light-emitting elements 11 mounted on each circuit board 11*a*1, sixty-four in total, are connected in series within the light-emitting unit A. After all light-emitting elements 11 are connected in series, the light-emitting unit A is preferably wired and connected to the lighting unit 17 and other adjacent light-emitting units A. One circuit board 11*a*1 has an input terminal at both ends of the wiring pattern connecting sixteen light-emitting elements 11 in series.

The connector 40 is an example of terminal unit, and is connected to the input terminal of the wiring pattern. The connector 40 is a small connector 40 in this embodiment. The connector 40 is removably fixed to the front side of the circuit board 11*a*1. The connector 40 is placed in the cavity 11*g* to be placed between adjacent light-emitting elements 11 as shown in FIG. 22 and FIG. 23. At this time, when the connection terminal 40*a* of the connector 40 is placed facing to the outside of the circuit board 11*a*1, the wiring operation is easy.

The lead wire 41 connecting the connectors 40 of each circuit board 11*a*1 in series is wired as follows. First, as shown in FIG. 22 and FIG. 23, four circuit boards 11*a*1 are positioned so that the connectors 40 are faced to each other, and placed on the radiator plate 11*j*. The connection terminal 40*a* of each connector 40 mounted on each circuit board 11*a*1 is placed to face the junction P of adjacent circuit boards 11*a*1 as shown in FIG. 23 and FIG. 25. The lead wire 41 is inserted into the connection terminal 40*a* in this state. The connection terminals 40*a* of the connectors 40 are aligned in the same direction, and can be collectively connected. The lead wire connected to each connector 40 is routed along the junction P of the circuit boards 11*a*1 as shown in FIG. 22 and FIG. 25. The connection terminals 40*a* of the connectors 40 are faced outward in the same direction. The lead wire 41 can be connected to the connector 40 at a position not interfering with each light-emitting element 11, and routed at a position not interfering with each light-emitting element 11.

Four reflectors 11*c* are layered on each circuit board 11*a*1 so that they are mounted along one plane. As a result, as shown in FIG. 23, the cavity 11*g* in the outermost periphery of each reflector 11*c* is combined at the junction Q of adjacent reflectors 11*c*. The combined cavity 11*g* forms a tunnel 11G having an isosceles triangular cross section as shown in FIG. 23, and extends along one side of the reflector 11*c* and circuit board 11*a*1. Each connector 40 connected to the lead wire 41 is covered by each cavity 11*g*. The lead wire 41 routed along the junction P of circuit boards 11*a*1 is housed in the tunnel 11G, except for the end portions 41*a* and 41*b* led out from the light-emitting unit A. In other words, the lead wire 41 is wired without being exposed on the surface of the circuit board

11*a*1. Therefore, the lead wire 41 does not disturb the assembling operation, and the workability is improved.

Figure 33:
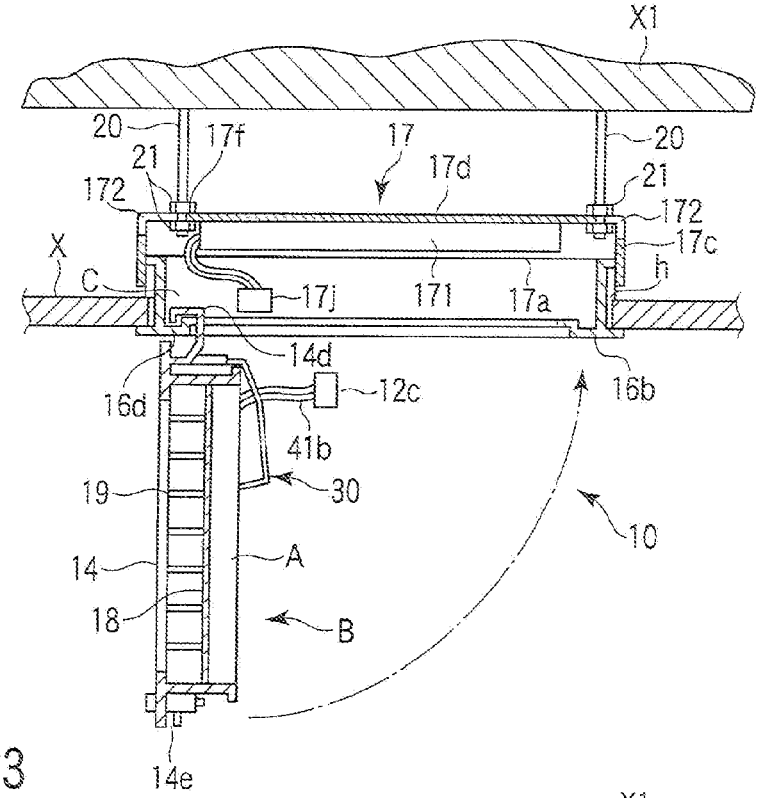
FIG. 33 is a sectional view of the state in which a main body frame having a light-emitting unit is suspended from the support frame shown in FIG. 32, along the line F33-F33 in FIG. 32.

As shown in FIG. 22, the end portion 41*a* led out in one direction from the tunnel 11G is led to the tunnel 11G of the adjacent light-emitting unit A, and connected to the corresponding connector. The connected lead wire 41 is passed through a tunnel formed in the adjacent light-emitting unit A. The end portion 41*b* of the lead wire 41 led out in the other direction is inserted into the connector 12*c*, and connected to the output terminal unit 17*j* of the lighting unit 17, as shown in FIG. 33. The connector 12*c* is connected to the terminal unit 17*j*, and the lighting unit 17 supplies power to all the light-emitting elements 11 of the light-emitting unit A.

Figure 24:
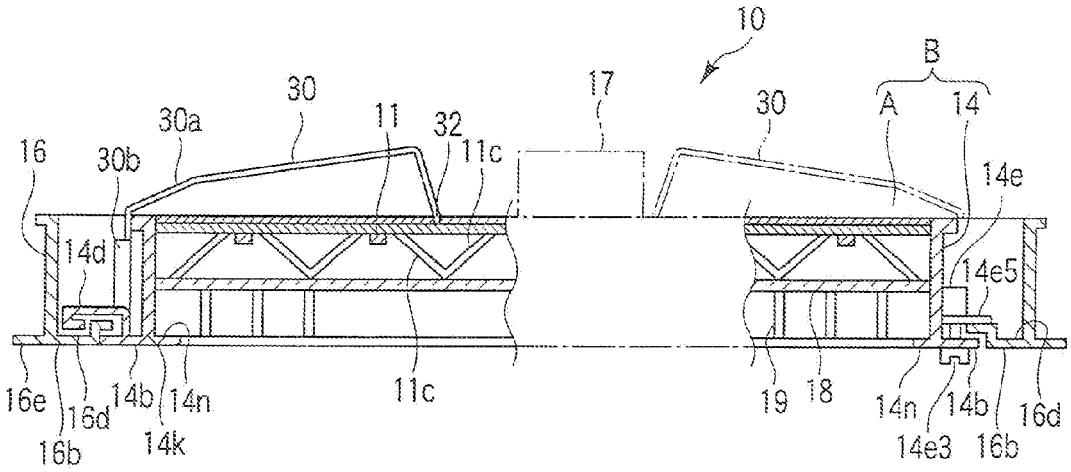
FIG. 24 is a vertical cross section of a luminaire provided with the light-emitting unit shown in FIG. 22.

The luminaire 10 of the second embodiment comprises an equipment main body B, a support frame 16, an engagement unit 14*c*, and a lighting unit 17, as shown in FIG. 24. The equipment main body B comprises the above-described light-emitting unit A, and main body frame 14. The main body frame 14 holds the light-emitting unit A on the inner periphery. The support frame 16 places the main body frame 14 on the inner periphery, and supports one end portion of the main body frame 14 rotationally movable. The engagement unit 14*c* engages the other end portion of the main body frame 14 with the support frame 16. The lighting unit 17 lights up the light-emitting elements 11.

Figure 27:
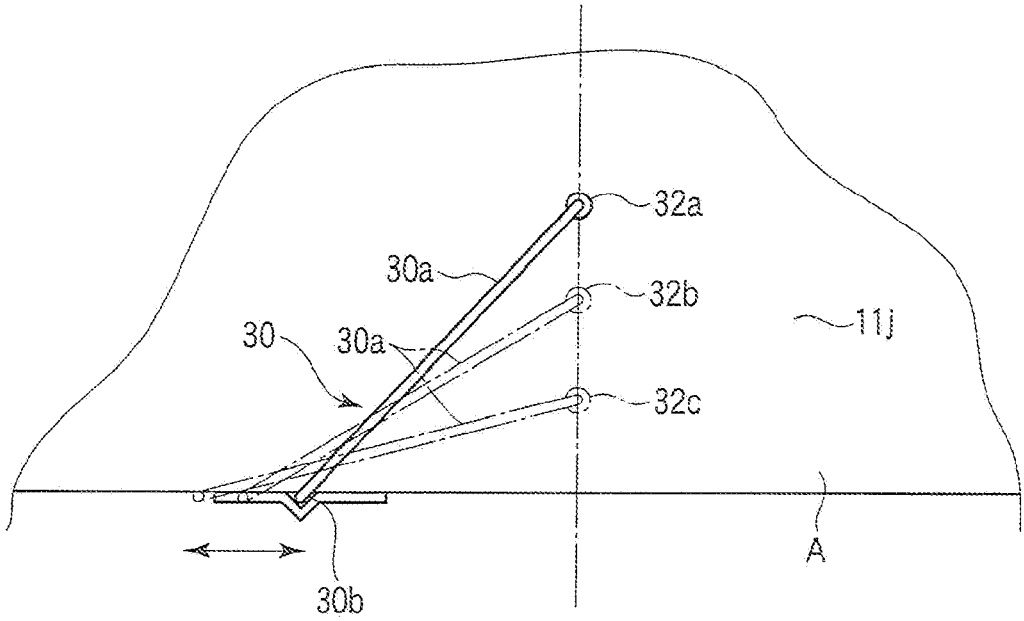
FIG. 27 is a plan view of the supporting member shown in FIG. 26 and a hole in a base substrate corresponding to the supporting member.
Figure 28:
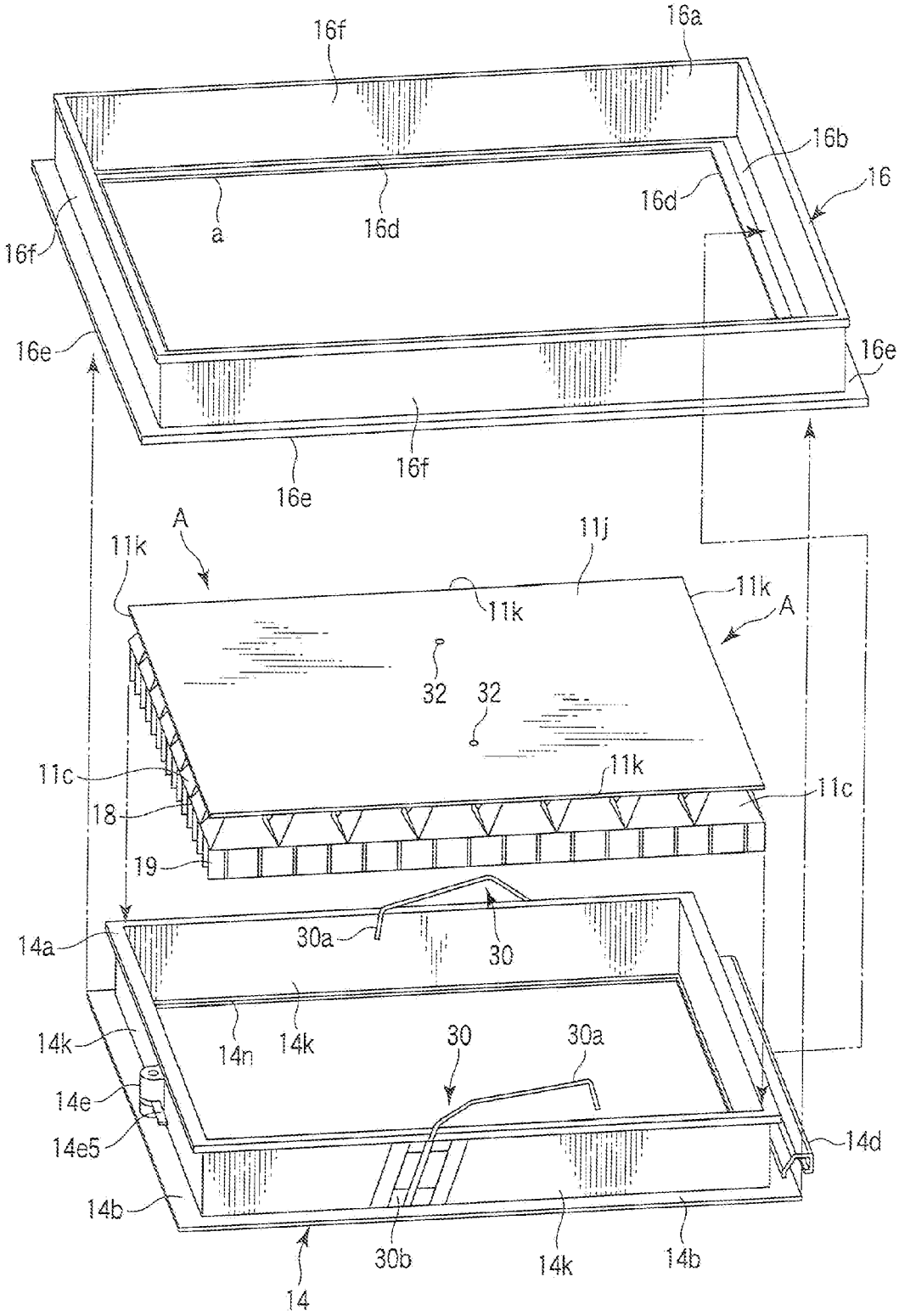
FIG. 28 is an exploded perspective view of the luminaire shown in FIG. 24.
Figure 29:
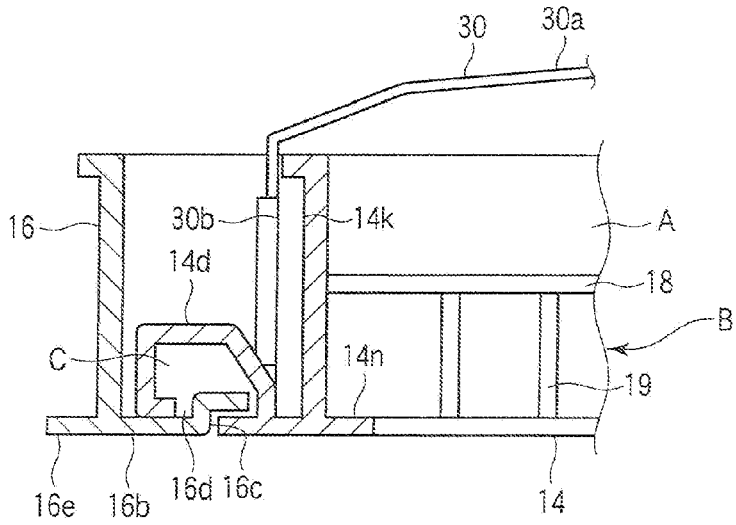
FIG. 29 is a magnified section view of a engaging piece and a receiving place of the luminaire shown in FIG. 24.

The main body frame 14 is made of metal with high heat conductivity, white painted aluminum in the second embodiment, and is formed in one piece with a square frame body 14*a*. The frame body 14*a* is sized to house the light-emitting unit A inside as shown in FIG. 24 and FIG. 27. The light-emitting unit A is fit in the main body frame 14, and the equipment main body B of the square luminaire is assembled. The main body frame 14 is formed in one piece with an outer flange 14*b* that becomes an ornamental frame projecting outward, on four outer sides of the frame body 14*a*. The outer flange 14*b* has a hook-shaped engaging piece 14*d* projecting on one side as shown in FIG. 28 and FIG. 29. The engaging piece 14*d* is extended along one side of the frame body 14*a*, having a predetermined cross section shape, and is formed in one piece with the outer flange 14*b* of the frame body 14*a*.

The luminaire 10 of the second embodiment comprises a transmissive plate 18 and a light control unit 19, as in the luminaire 10 of the first embodiment, as shown in FIG. 24. The transmissive plate 18 and light control-unit 19 are inserted in the frame body 14*a* of the main body frame 14, together with the square light-emitting unit A. The light control unit, transmissive plate 18, and light-emitting unit A are Layered and inserted into the main body frame 14 in this order, and are supported by the inner flange 14*n* of the main body frame 14.

Figure 26:
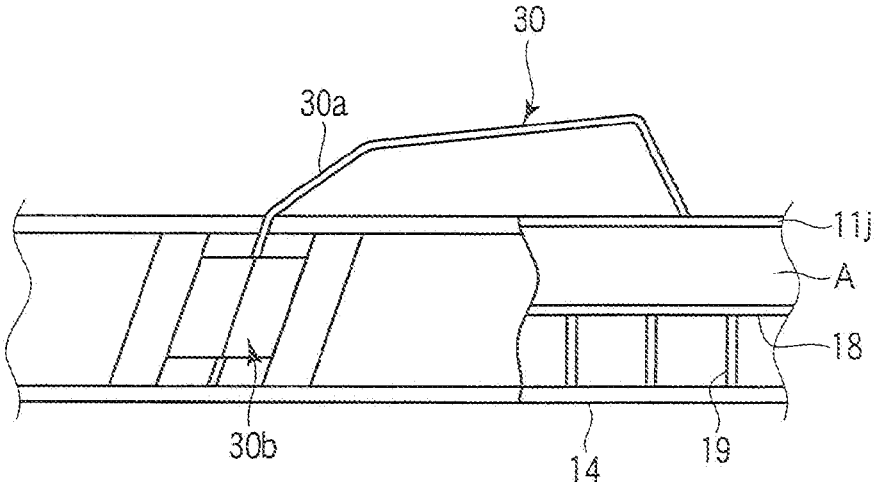
FIG. 26 is a side view of a supporting member of the luminaire shown in FIG. 24.

The light-emitting unit A, transmissive plate 18, and control unit 19 are held in the frame body 14*a* by the support member 30 that is a holding member, as shown in FIG. 24, FIG. 26 and FIG. 33. The support member 30 is a wire made by bending an elastic steel wire 30*a* to meet the purpose of this embodiment. The distal end of the support member 30 is fixed to a predetermined position by a positioning means comprising three small holes 32*a*, 32*b* and 32*c* formed on the rear side of the radiator plate 11*j* shown in FIG. 23 and FIG. 27.

The proximal end of the support member 30 is fixed to the side plate 14*k* of the main body frame 14 as shown in FIG. 24, FIG. 26 and FIG. 28. The proximal end 30*b* is slidable along the side plate 14*k* as shown in FIG. 27. The proximal end 30*b* is configured to rotationally move the wire 30*a* about the axis line inclined slightly to the vertical line of the radiator plate 11*j* of the base substrate 11*a*. In other words, the center of rotational movement of the wire 30*a* is set obliquely to the vertical line of the radiator plate 11*j*.

When the wire 30*a* is rotationally moved, the distal end of the wire 30*a* extending radially from the center of rotation is moved along the inclined circular orbit. As a result, by sliding the proximal end 30*b* of the support member 30 and rotationally moving the wire 30*a*, the distal end of the wire 30*b* is moved outward from the center of the radiator plate 11*j*, and displaced in the direction of pushing the radiator plate 11*j* down to the circuit board 11*a*1. The three small holes 32*a*, 32*b* an 32*c* shown in FIG. 27 are prepared for cases where the distal end of the wire 30*a* is set high, middle, and low positions for the inner flange 14*n* of the main body frame 14.

The luminaire 10 is provided with a mechanism which changes the position of the distal end of the support member 30 in the thickness direction of the main body frame 14, that is, in the light emission direction. This permits use of the reflector 11*c*, transmissive plate 18 and light control unit 19 with different dimensions in the light emission direction. As shown in FIG. 27, three small holes 32*a*, 32*b* and 32*c* may be formed by penetrating the base substrate 11*a* up to the cavity 11*g* of the above-mentioned reflector 11*c*. In this case, the circuit board 11*a*1 is sufficiently insulated. The number of holes, which prevents interference of the distal end of the wire 30*a* with the light-emitting element 11, is not limited to three. The number of holes depends on the number of positions to support the radiator plate 11*j* by the support member 30.

The main body frame 14 has an engagement unit 14*e* to engage the main body frame 14 with the support frame 16, on the side plate 14*k* of the frame body 14*a* that is the side opposite to the side forming the engaging piece 14*d* as shown in FIG. 24. The engagement unit 14*e* comprises a stopper 14*e*1 and a bearing 14*e*2 as in the engagement unit 14*e* of the first embodiment. The stopper 14*e*1 is a part formed by combining a screw heat 14*e*3, a projection 14*e*4, and a stopper piece 14*e*5 in one piece with a shaft member. The bearing 14*e*2 is formed in one piece with the side plate 14*k* of the frame body 14*a*. The bearing 14*e*2 has a recess 14*e*6 inside. The projection 14*e*4 and recess 14*e*6 form a lock mechanism 141. When the projection 14*e*4 of the stopper 14*e*1 engages with the recess 14*e*6, the stopper piece 14*e*5 engages with the inner flange 16*b*, and holds the main body frame 14 in the support frame 16.

Figure 30:
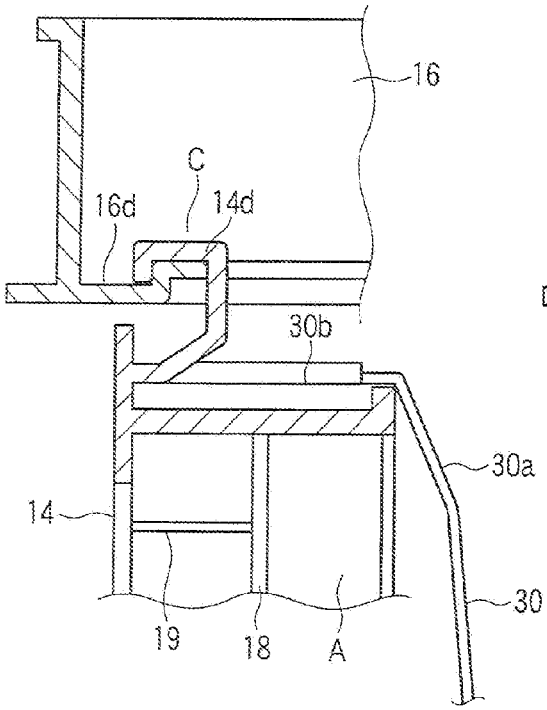
FIG. 30 is a sectional view of the state in which the engaging piece is hooked in the receiving place shown in FIG. 29, and a main body frame is suspended from a support frame.
Figure 31:
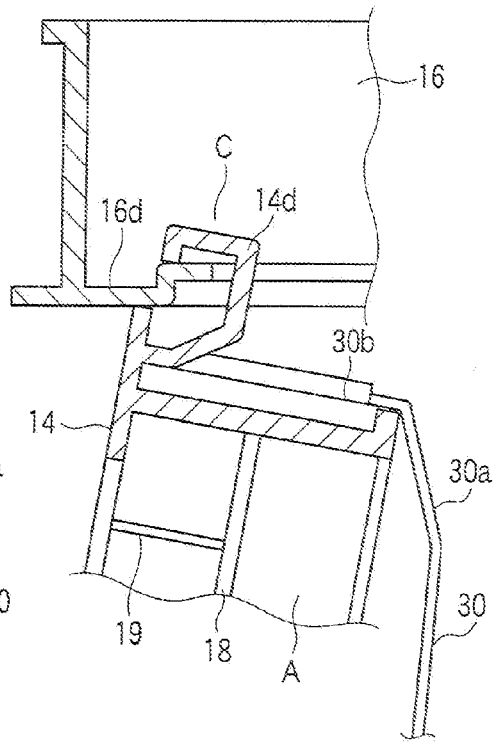
FIG. 31 is a sectional view of the state in which the engaging piece is going to be removed from the receiving place shown in FIG. 30.
Figure 32:
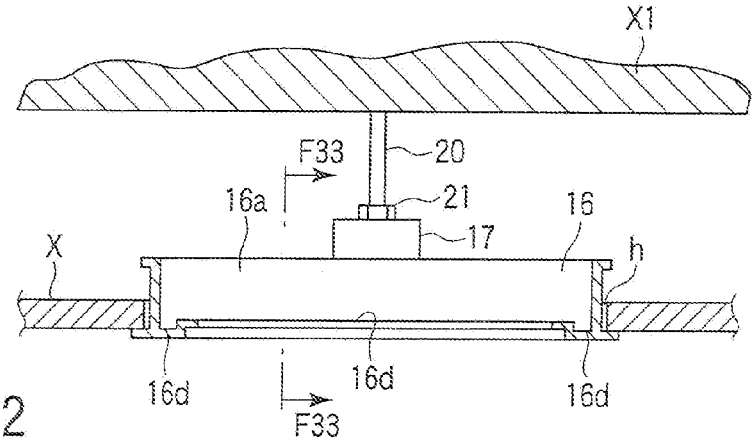
FIG. 32 is a perspective view of the state in which the support frame and lighting unit of the luminaire shown in FIG. 24 are installed on a ceiling.

The luminaire 10 configured as above is installed on a ceiling as shown in FIG. 29 to FIG. 34 in the same procedures as the first embodiment. In the luminaire 10 of this embodiment, the receiving place 16*d* is provided on all inner peripheral sides of the support frame 16 as shown in FIG. 32. The receiving place 16*d* uses the part provided on the side of the frame body 16*a*, from which the output terminal unit 17*j* of the lighting unit 17 is pulled out to the support frame 16, as shown in FIG. 33. The main body frame 14 engages the engaging piece 14*d* with the receiving place 16*d* as shown in FIG. 33. In other words, the output terminal unit 17*j* pulled out from one end of the lighting unit 17 is placed on the side, on which the hinge C of the support frame 16 and main body frame 14 are provided.

Figure 34:
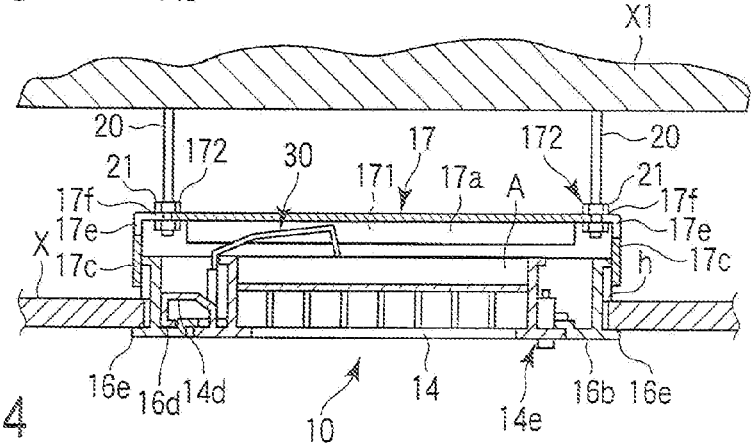
FIG. 34 is a sectional view of the state in which the main body frame shown in FIG. 33 is housed in the support frame.

The luminaire of this embodiment comprises a support member 30. As shown in FIG. 33, a light control unit 19, a transmissive plate 18, and a light-emitting unit A are inserted in this order into the frame body 14*a* of the main body frame 14 suspended as shown in FIG. 33, and the light control unit 19 is locked on the inner surface of the inner flange 14*n* of the main body frame 14. Next, the wire 30*a* of the support member 30 is rotationally moved to insert the distal end into one of the positioning small holes 32*a*, 32*b* and 32*c*. As shown in FIG. 33, the light-emitting unit A is pressed to the inner surface of the inner flange 14*n* of the main body frame 14 by the elasticity of the wire 30*a*, and held on the inner periphery of the main body frame 14. As shown in FIG. 34, after the main body frame 14 is fit in the support frame 16, the support member 30 is located at a position not interfering with the lighting unit 17.

The connector 12*c* provided in the end portion 31*b* of the lead wire 41 led out from the light-emitting unit A is connected to the terminal unit 17*j* of the lighting unit 17. As the lighting unit 17 and light-emitting unit A can be wired and connected in the hinge C, the lead wire 41 of the lighting unit may be short and does not disturb the installation operation. Further, operation of assembling the light control unit 19, transmissive plate 18 and light-emitting unit A to the main body frame 14, and the operation of wiring and connecting the terminal unit 17*j* to the connector 12*c* can be performed in the state in which the main body frame 14 is pulled out and suspended from the support frame 16. This makes the operation visible, and improves the workability.

When the light-emitting unit A as a light source is removed for replacement or maintenance, the procedures reverse to installation of the luminaire are used as same as the first embodiment. In this case, the support member 30 has been combined with the luminaire 10 of the second embodiment. Therefore, first the wire 30*a* of the support member 30 holding the light-emitting unit A as shown in FIG. 33 in the main body frame 14 is led out from the small hole 32 in the state in which the main body frame 14 has been locked to suspended from the support frame 16 as shown in FIG. 30. Then, the wire 30*a* is removed from the top surface of the light-emitting unit A by turning it to remove from the frame body 14*a* of the main body frame 14.

When the light-emitting unit A is removed together with the main body frame 14, first the connector 12*c* is separated from the terminal unit 17*j*, and as shown in FIG. 31, the engagement of the engaging piece 14*d* with the groove of the receiving place 16*d* is released. As the support member 30 is provided, the light-emitting unit A, transmissive plate 18 and light control unit 19 are prevented from coming off the main body frame 14 even in the state in which the main body frame 14 is suspended from the support frame 16.

In the luminaire 10 of this embodiment, a cavity 11*g* is formed between the circuit board 11*a*1 provided with the light-emitting element 11 and the reflector 11*c* covering the area around the light-emitting element 11. By arranging two or more reflectors 11*c*, a tunnel 11G of the size of combined cavities 11*g* is formed at the junction Q of adjacent reflectors 11*c*.

The connector 40 is located between adjacent light-emitting elements 11 in the tunnel 11G. Therefore, the connector 40 does not contact the light-emitting elements 11 and energized parts. The lead wire 41 connected to the connector 40 is housed in the tunnel 11G. The lead wire 41 does not interfere with the light-emitting elements 11 and energized parts. As the connector 40 and lead wire 41 do not interfere with the light-emitting elements and energized parts on the circuit board 11*a*1, the reflector 11 can tightly contact the circuit board 11*a*1. As the light emitted from the light-emitting element 11 does not leak to the rear side of the reflector 11*c*, lighting loss of the luminaire 10 is eliminated.

Further, the lead wire 41 is led from one side of the frame body 14*a* opposing the light-emitting unit A, and does not interfere with the reflector 11*c* and light-emitting elements 11. Space for housing the lead wire 41 is unnecessary, and the light-emitting unit A can be made compact. The connector 40 is adjoined to the junction P of circuit boards 11*a*1, and arranged opposing to the connection terminal 40*a*. This increases the efficiency of wiring the lead wire 41. The lead wire 41 connecting adjacent circuit boards 11*a*1 is housed in the tunnel 11G that is normally a dead space. As a result, the lead wire 41 is neatly wired for the light-emitting unit A, and the workability of installation and maintenance is improved.

Figure 35:
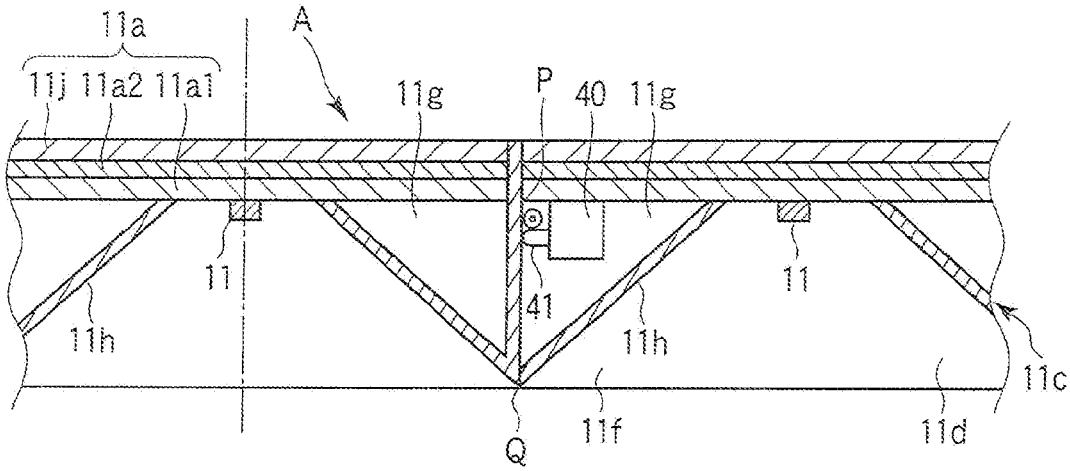
FIG. 35 is a sectional view of a first modification of the light-emitting unit shown in FIG. 23.
Figure 36:
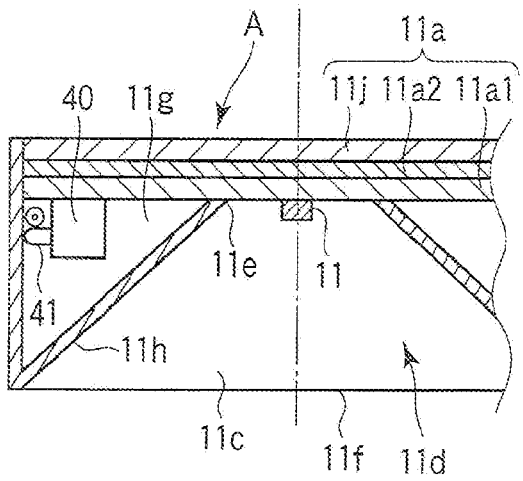
FIG. 36 is a sectional view of a second modification of the light-emitting unit shown in FIG. 23.

In the luminaire 10 of this embodiment, cavities 11*g* are combined at the junction Q of reflectors 11*c*, forming a tunnel 11G having an isosceles triangular cross section. As shown in FIG. 35, the shape of the reflector 11*c* used in being combined may not be the same. The cavity 11*g* is formed only in one reflector 11*c*, and the connector 40 and lead wire 41 are located or housed in this cavity 11*g*. In this case, adjacent reflectors 11*c* have a side wall closed along the junction Q. When one reflector 11*c* is provided in one luminaire 10, a cavity 11*g* is formed one side of the outermost periphery as shown in FIG. 36. The connector 40 and lead wire 41 may be located or housed in the cavity 11*g*.

Next, a luminaire according to a third embodiment of the invention will be explained with reference to FIG. 37 to FIG. 47. The components having the same functions as those of the first and second embodiments are denoted by the same reference numbers in the drawings, and an explanation thereof is omitted. Diagrams of the same structures are also omitted. Therefore, for the configuration not described in detailed in this embodiment, related drawings and explanation of the first and second embodiments will be referred to. Even components peculiar to the luminaire 10 of the third embodiment may be added to or replaced by the components of the luminaire 10 of the first and second embodiments.

Figure 37:
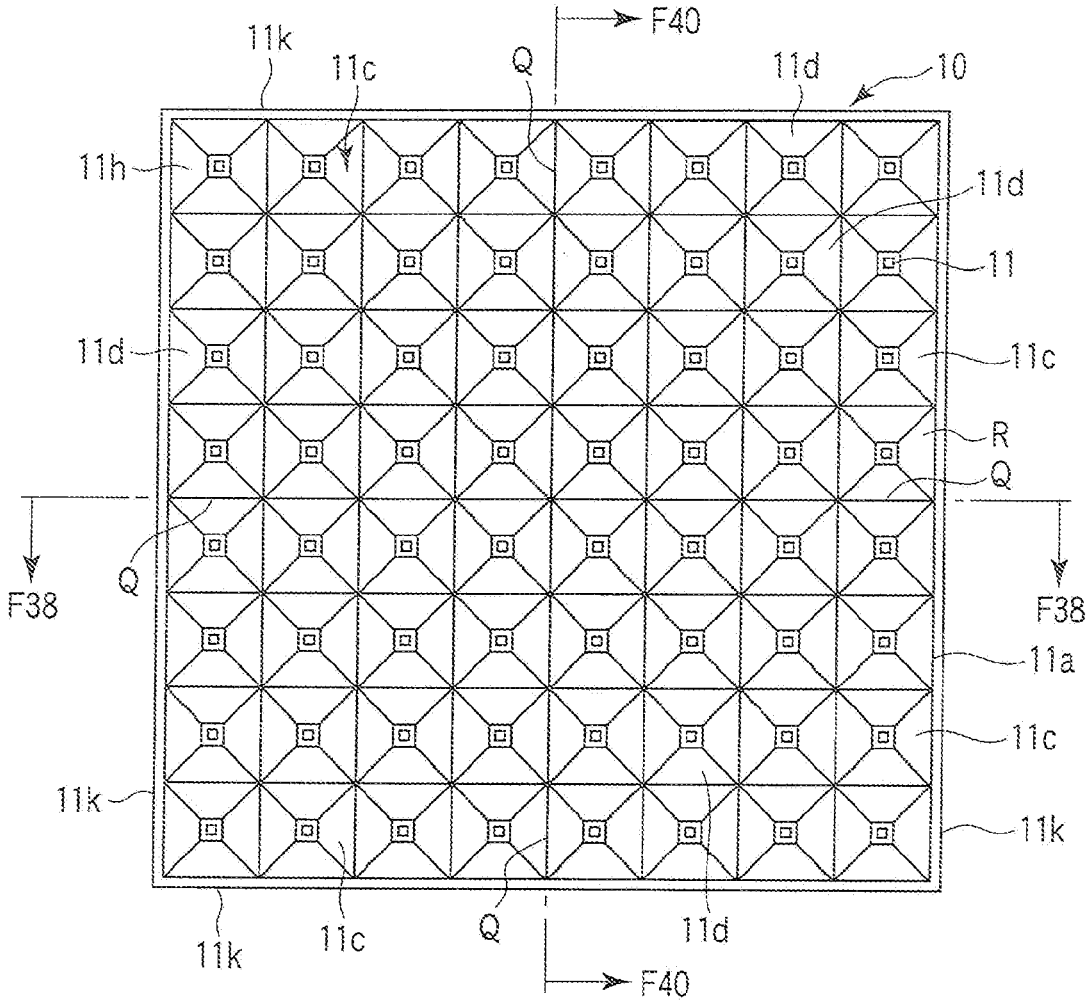
FIG. 37 is a front view of a light-emitting unit of a luminaire according to a third embodiment of the invention.
Figure 38:
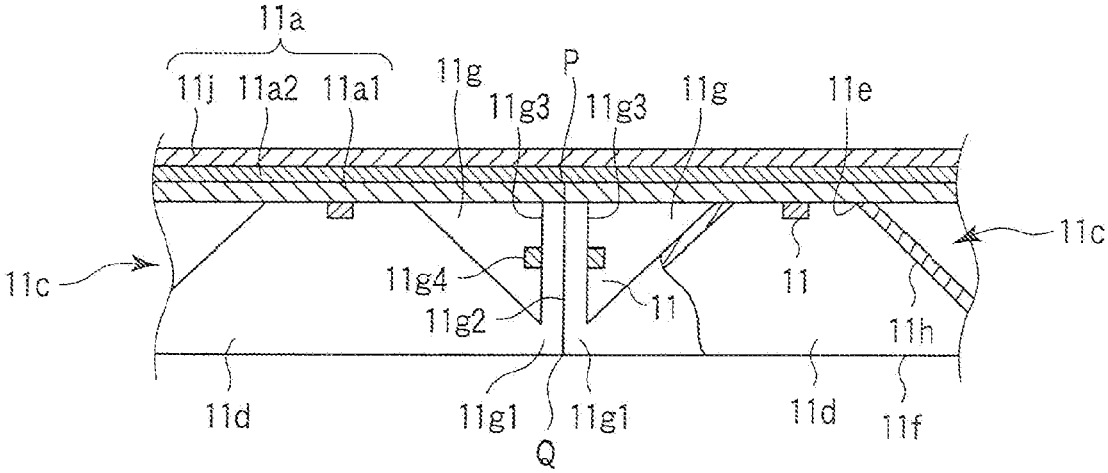
FIG. 38 is a sectional view of the light-emitting unit along the line F38-F38 in FIG. 37.

As shown in FIG. 37, the luminaire 10 is a recessed ceiling type, and adopts a light-emitting unit A made in the form of a rectangular flat plate. In this embodiment, the light-emitting unit A is shaped square. The light-emitting unit A comprises a substrate 11*a* on which two or more light-emitting elements 11 are mounted, and a reflector R which reflects the light emitted from each light-emitting element 11. The base substrate 11*a* comprises a substrate 11*a*1, an electrical insulating plate 11*a*2, and a radiator plate 11*j*. In this embodiment, one base substrate 11*a* includes four circuit boards 11*a*1 as shown in FIG. 37 to FIG. 38.

Figure 40:
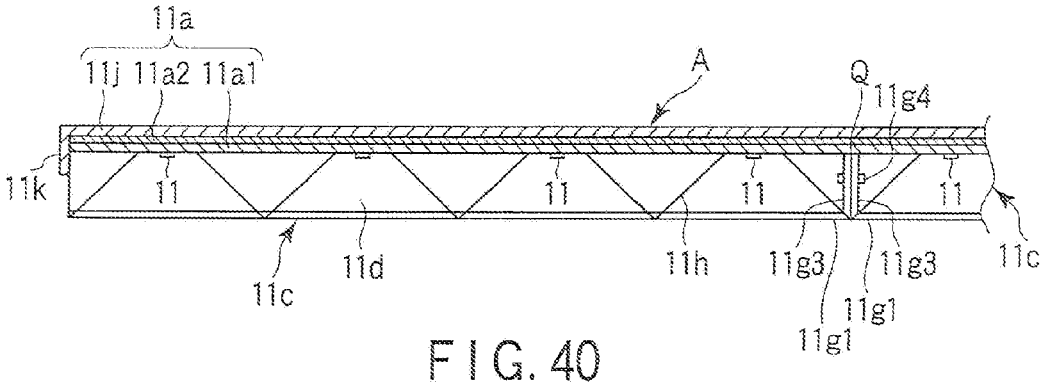
FIG. 40 is a sectional view of the light-emitting unit along the line F40-F40 in FIG. 37.

The radiator plate 11*j* is made of metal with high heat conductivity, such as a steel plate and aluminum. In this embodiment, the radiator plate 11*j* is made of a steel plate. The radiator plate 11*j* is formed in square of the size equivalent to four circuit boards 11*a*1 arranged in square. The radiator 11*j* has a brim 11*k* raised in one piece toward the circuit board 11*a*1 as shown in FIG. 37 and FIG. 40.

One electrical insulating plate 11*a*2 is inserted between four circuit boards 11*a*1 and a radiator plate 11*j*. The electrical insulating plate 11*a*2 is a film-like insulating sheet made of heat-resistant insulating silicon resin or epoxy resin. The electrical insulating plate 11*a*2 is shaped square to be fit inside the brim 11*k* of the radiator plate 11*j*.

A reflection unit R comprises four reflectors 11*c* as shown in FIG. 37. The reflector 11*c* is provided corresponding to the circuit board 11*a*1. Four reflectors 11*c* are optically designed to obtain desired light distribution. Therefore, four reflectors may have the same shape, or different shapes to obtain uneven light distribution. The reflector 11*c* is made of heat-resistant weather-resistant insulating synthetic resin. In this embodiment, one reflector 11*c* is made of white polybutylene terephthalate (PBT) in the form of square with the same outer dimensions as one circuit board 11*a*1. The reflector 11*c* has a square pyramid concave portion 11*d* corresponding to the number of light-emitting elements 11 of the circuit board 11*a*1, and is shaped like a so-called waffle. In other words, a conical-shaped or funnel-shaped concave portion 11*d* is arranged corresponding to the arrangement of light-emitting elements 11, as shown FIG. 38. The bottom of each concave portion 11*d* has an opening 11*e*. The light-emitting element 11 is arranged at the center of the opening 11*e*. The concave portion 11*d* is formed surrounding the light-emitting element 11.

Figure 39:
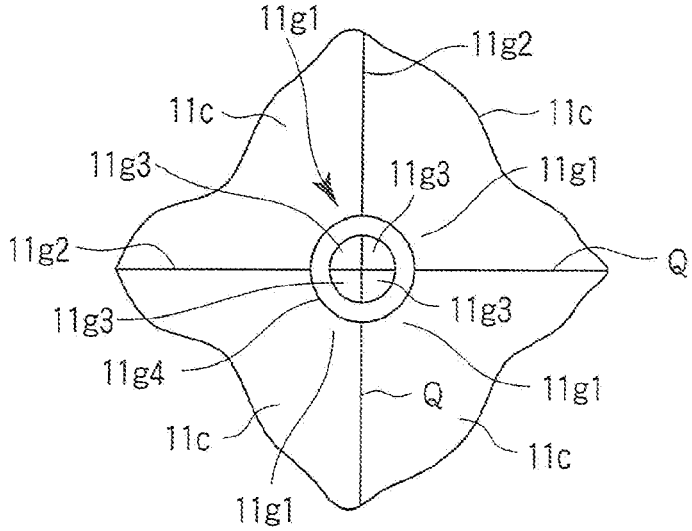
FIG. 39 is a rear view of the part around a supporting piece shown in FIG. 38.
Figure 41:
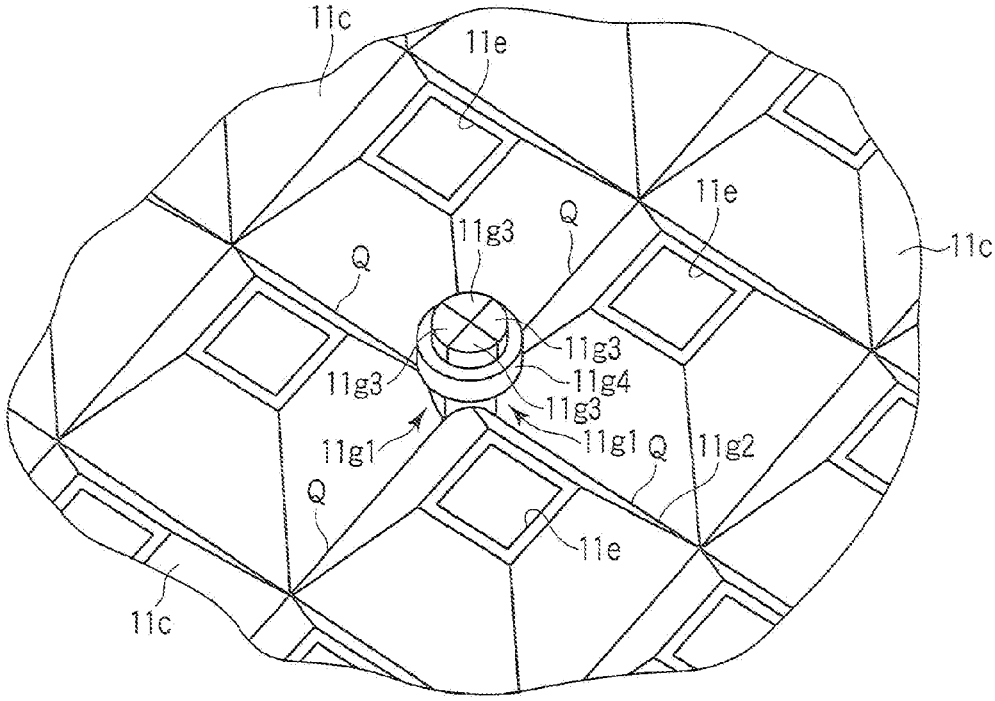
FIG. 41 is a perspective view of the supporting piece shown in FIG. 39 and the part around the supporting piece.
Figure 42:
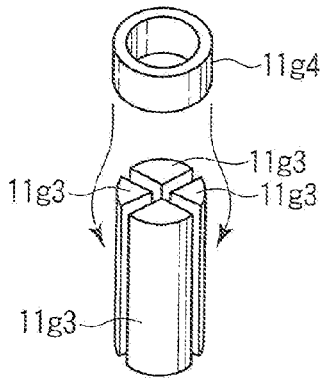
FIG. 42 is an exploded perspective view of the supporting piece and fastening member shown in FIG. 41.

Each reflector 11*c* has a jointing piece 11*g*3 extending perpendicularly from the outer periphery to the base substrate 11*a*. In this embodiment, as shown in FIG. 38, the reflector 11*c* is formed in one body with a jointing piece 11*g*3, which is located at least one corner Ugh, and extended to the base substrate 11*a*. Further, as shown in FIG. 38 and FIG. 39, the jointing piece 11*g*3 is not projected to the outside from the outer peripheral surface 11*g*2 of the reflector 11*c*. In other words, the jointing piece 11*g*3 is formed as a ¼-divided part of a cylinder, as shown in FIG. 41 and FIG. 42.

Four reflectors 11*c* are arranged flatly in 2-row and 2-column square along the base substrate 11*a*. The corners 11*g*1 provided with a jointing piece 11*g*3 are butted against at the center of the base substrate 11*a*. The jointing pieces 11*g*3 of the reflectors 11*c* are joined in the outer peripheral side 11*g*2, and bound to form one cylinder. The bound jointing pieces 11*g*3 are united in one piece by a fastening ring 11*g*4 that is a fastening means, as shown in FIG. 39 and FIG. 40. The fastening ring 11*g*4 is made of synthetic resin composed of polybutylene terephthalate (PBT) in the form of a ring. The other configurations are the same as those in the luminaire 10 of the first and second embodiments.

In the luminaire 10, the light-emitting unit A is assembled in the following procedure. First, the electrical insulating plate 11*a*2 is attached inside the brim 11*k* of the radiator plate 11*j*. Next, four circuit boards 11*a*1 are positioned for the radiator plate 11*j* with reference to the brim 11*k*. At this time, the circuit boards 11*a*1 are closely arranged without a clearance at the junction P. Four reflectors 11*c* are arranged corresponding to the circuit boards 11*a*1. At this time, the corners 11*g*1 are opposed so that the jointing pieces 11*g*3 of adjacent reflectors 11*c* are made contact each other. As a result, the jointing pieces 11*g*3 of four ¼-divided parts of a cylinder are joined forming one cylinder as shown in FIG. 39 and FIG. 41. A fastening ring 11*g*4 is fit onto the bound jointing pieces 11*g*3 of the reflector 11*c* separated from the base substrate 11*a* from the rear side as shown in FIG. 42.

Four reflectors 11*c* are tightly connected at the central part of the base substrate 11*a* by the fastening ring 11*g*4. As a result, four reflectors 11*c* tightly contact to one another at the junction Q, and assembled as one reflector unit R. The reflector unit R assembled as one piece is positioned on the top surface of four circuit boards 11*a*1 by the brim 11*k* of the radiator plate 11*j*. The reflector unit R is assembled together with the circuit boards 11*a*1 by a screw inserted from the rear side of the radiator plate 11*j*. The reflector unit may be bonded by a heat-resistant insulating adhesive such as silicon resin and epoxy resin.

As the jointing pieces 11*g*3 are connected by the fastening ring 11*g*4 at the central part of the light-emitting unit A, four reflectors 11*c* of the light-emitting unit A assembled as above tightly contact at the junction Q. Therefore, the light emitted from the light-emitting element 11 does not leak from the junction Q.

The light-emitting unit A configured as described above is inserted into the main body frame 14 as in the first and second embodiments. The main body frame 14 assembled with the light-emitting unit A is combined with the support frame 16, forming the luminaire 10. In the luminaire 10, the main body frame 14 may be removed from the support frame 16 for cleaning and maintenance or replacement of light-emitting elements. The light-emitting unit A may be removed from the main body frame 14.

The reflector 11*c* of the light-emitting unit A removed from the main body frame 14 can be removed from the circuit board 11*a*1 in the following procedures. First, the screw assembling the reflector 11*c*, circuit board 11*a*1 and radiator plate 11*j* is removed. The reflector 11*c* comes off the base substrate 11*a* as one piece. Then, the fastening ring 11*g*4 binding the jointing pieces 11*g*3 is removed. The reflector 11*c* is disassembled to four pieces.

According to the luminaire 10 of the third embodiment, the reflector 11*c* is formed in one piece with a jointing piece 11*g*3 extending from one corner 11*g*1 to the base substrate 11*a*. The jointing piece 11*ge*3 is formed as a ¼-divided part of a cylinder. When four reflectors 11*c*1 are flatly arranged along the square base substrate 11*a*, they are placed so that the jointing pieces 11*g*3 oppose each other. The jointing piece 11*g*3 does not project outward from the outer peripheral side 11*g*2, so that the outer peripheral side 11*g*2 that is the periphery extending from the corner 11*g*1 provided with the jointing piece 11*g*3 tightly contact each other. As a result, the reflectors 11*c* are arranged along the base substrate 11*a*, and the reflector unit R is formed.

Adjacent reflectors 11*c* arranged so that the jointing pieces 11*g*3 contacts at the corner 11*g*1. Adjacent four jointing pieces 11*g*3 form one cylinder. Four reflectors 11*c* of the light-emitting unit A are tightly connected by the fastening ring 11*g*4 at the central part of the light-emitting unit A. As four reflectors 11*c* tightly contact without clearance at the junction Q, the light emitted from the light-emitting element 11 does not lead from the junction Q. Further, as no clearance is found at the junction Q when viewed from the front side of the reflector 11*c* while the luminaire is not lit, the light-emitting unit A and luminaire 10 provide excellent appearance. The jointing piece 11*g*3 is provided extending perpendicularly to the base substrate 11*a* in the state not projecting outward from the outer peripheral side 11*g*2 of the corner 11*g*1 of the reflector 11*c*. There is no projection at the junction Q of adjacent reflectors 11*c*, and the outer peripheral sides 11*g*2 of adjacent reflectors 11*c* tightly contact without clearance.

The reflector 11*c* may be provided with a jointing piece 11*g*3 at least one corner 11*g*1. This simplifies the structure of the reflector. When four reflectors 11*c* are assembled, the reflectors 11*c* are positioned so that the jointing pieces 11*g*3 of adjacent reflectors 11*c* contact each other. Four reflectors may be made in the same shape. The number of parts is decreased, and the cost is reduced.

Figure 43:
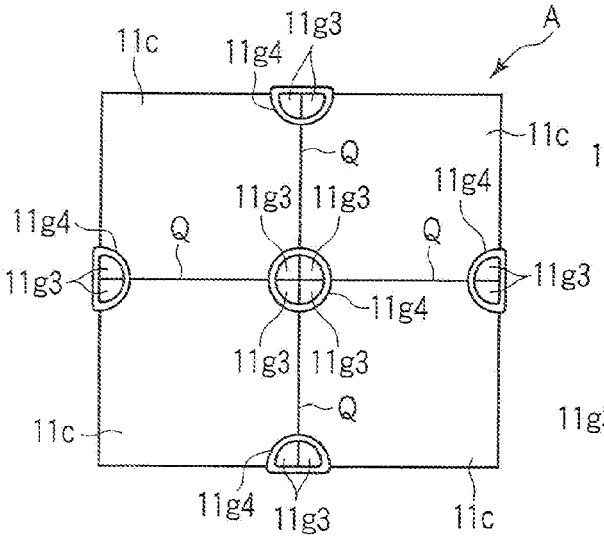
FIG. 43 is a rear view of a first modification of the light-emitting unit shown in FIG. 37.

In the third embodiment, the junction Q of the outer peripheral side 11*g*2 located on the outer periphery of the light-emitting unit A, connecting the corners 11*g*1 of the reflectors 11*c* at the central part of the light-emitting unit A, is positioned by the brim 11*k* formed on four sides of the radiator plate 11*j* so that no clearance is generated. A junction may be provided on the outer peripheral side of the light-emitting unit A as shown in FIG. 43, without depending on the brim 11*k*. A junction comprises ¼-divided parts of a cylinder, and a semicircular fastening ring 11*g*4. The jointing piece 11*g*3 is provided at the corner 11*g*1 positioned on the outer peripheral side of the light-emitting unit A. The fastening ring 11*g*4 is fit onto two jointing pieces 11*g*3 contacting each other.

Figure 44:
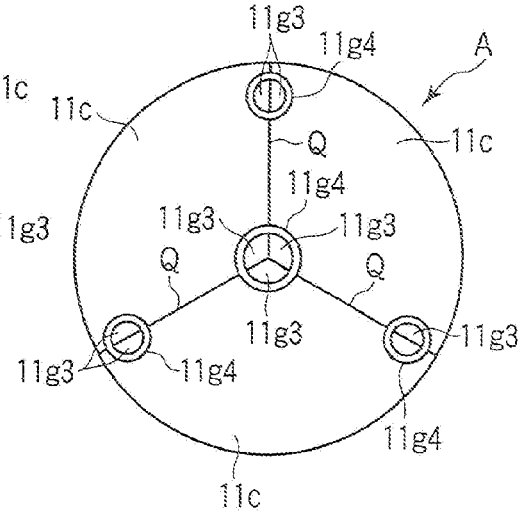
FIG. 44 is a rear view of a second modification of the light-emitting unit shown in FIG. 37.

By using the D-shaped semicircular fastening ring, two reflectors 11*c* can be combined into a light-emitting unit A. As shown in FIG. 43, the jointing piece 11*g*3 that is a ¼-divided part of a cylinder is formed at opposing corners of adjacent reflectors 11*c*, and the D-shaped fastening ring is fit onto the jointing pieces to fasten them. As shown in FIG. 44, fan-shaped three reflectors 11*c* may be combined into a circular light-emitting unit A. In this case, a jointing piece 11*g*3 is provided at a corner 11*g*1 of a reflector 11*c* positioned at the center of the light-emitting unit A. The jointing piece 11*g*3 is formed as a ⅓-divided part of a cylinder. These parts are joined by a circular fastening ring 11*g*4. A jointing piece 11*g*3 joined by a fastening ring 11*g*4 may be provided to tightly contact the junction Q located in the outer periphery of the light-emitting unit A. The jointing piece 11*g*3 is formed as a ½-divided part of a cylinder at corners 11*g*1 of adjacent reflectors.

Figure 45:
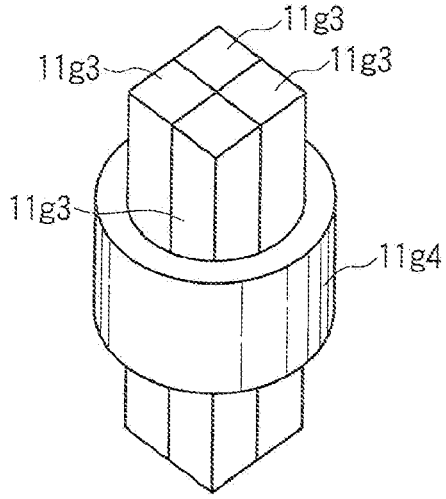
FIG. 45 is a perspective view of a first modification of the supporting piece and fastening member shown in FIG. 41.
Figure 46:
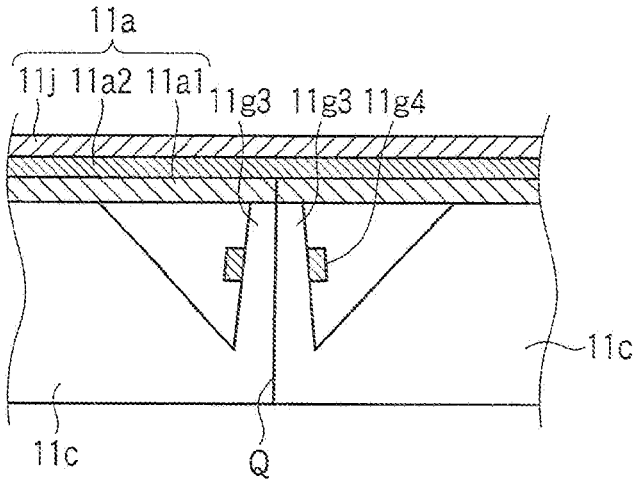
FIG. 46 is a perspective view of a second modification of the supporting piece and fastening member shown in FIG. 38.
Figure 47:
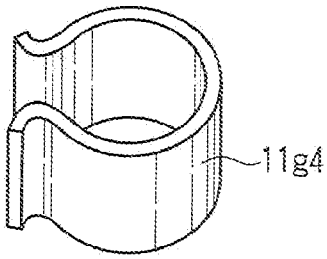
FIG. 47 is a perspective view of a first modification of the fastening member shown in FIG. 42.

In the third embodiment, four jointing pieces 11*g*3 are combined into a cylindrical column. As shown in FIG. 45, each jointing piece 11*g*3 may be formed as a part of a square column, and fastened by a circular or square fastening ring. Further, as shown in FIG. 46, four jointing pieces 11*g*3 may be combined into a form whose surface is tapered and reduced in diameter toward the base substrate 11*a*. The fastening ring 11*g*4 is formed to have a tapered hole. The jointing pieces 11*g*3 and fastening ring may be combined in the tapered so that they are not easily separated. Further, as shown in FIG. 47, the fastening ring 11*g*4 may be composed of a C-shaped metallic or synthetic resin spring member, lacking a part of a ring.

In the embodiments described hereinbefore; the main body frame 14 and support frame 16 are made of metal with high heat conductivity. They may be made of heat-resistant weather-resistant insulating synthetic, such as polybutylene terephthalate (PBT).

The engaging piece 14*d* is formed in one piece of the synthetic main body frame 14. The engaging piece 14*d* may be made of metal, formed like a hook separately from the main body frame 14, and attached to one side of the main body frame 14. The receiving place 16*d* is formed on every side, or four sides of the rectangular support frame 16. When the receiving place 16*d* is provided on only one side of the support frame, not on four sides, the invention may be embodied. The lock mount piece 16*d* may be formed in one piece with the synthetic resin support frame 16 as described above, or a separate metallic lock mount piece formed like a groove is provided on four sides of the support frame 16.

The lighting unit 17 may be provided in the main body frame 14 or light-emitting unit A. The lighting unit 17 may be installed on the back side of a ceiling, separately from the main body frame and light-emitting unit A.

A luminaire of the type recessed in an installation site on a ceiling is explained hereinbefore as an example of the invention. The invention may be applied to a luminaire to be directly installed on a ceiling. The embodiments described hereinbefore are preferable examples for explaining the invention. Therefore, the invention is not limited to the described embodiments. The design of the invention may be modified various forms without departing from the spirit and essential characteristics of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A luminaire comprising:

a light-emitting unit comprising:

a plurality of light-emitting elements, a base substrate having a plate-shape on which two or more light-emitting elements are mounted, and a terminal unit which is provided on the base substrate, and connected to the light-emitting elements;

a main body frame configured to support the light-emitting unit, and formed rectangular having a hook-shaped engaging piece on one side;

a support frame which is formed rectangular surrounding the outer periphery of the main body frame, and has a groove-shaped receiving place which engages with the engaging piece, on one interior side; and a lighting unit configured to turn on the light-emitting elements, the lighting unit comprising:

a case configured to be fastened to the support frame, and to be suspended on a ceiling with a suspension bolt, and a lighting circuit which is assembled in the case, wherein:

the lighting circuit comprises a power cable extending from a side in which the case and the support frame are jointed, and the light-emitting unit comprises a lead wire connected to the power cable and extending from the terminal unit arranged on a side provided with the engaging piece.

2. The luminaire according to claim 1, wherein the light-emitting unit comprises:

a reflector which is attached on a mounted side of the base substrate on which the light-emitting elements are mounted, and has a reflection surface formed by slopes surrounding each of the light-emitting elements.

3. The luminaire according to claim 2, wherein the light-emitting unit comprises:

a reflector which is attached on a mounted side of the base substrate on which the light-emitting elements are mounted, and has a reflection surface formed by slopes surrounding each of the light-emitting elements.

4. A luminaire comprising:

a light-emitting unit comprising:

a plurality of light-emitting elements, a base substrate having a plate-shape on which two or more light-emitting elements are mounted, and a terminal unit which is provided on the base substrate, and connected to the light-emitting elements;

a main body frame configured to support the light-emitting unit, and formed rectangular having a hook-shaped engaging piece on one side;

a support frame which is formed rectangular surrounding the outer periphery of the main body frame, and has a groove-shaped receiving place which engages with the engaging piece, on one interior side;

a lighting unit which turns on the light-emitting elements; and an engagement unit configured to hold the main body frame inside the support frame, the engagement unit comprising:

a stopper piece provided in one of an outer peripheral edge of the main body frame, that is an opposite side to a side provided with the engaging piece, and an inner peripheral edge of the support frame adjacent to the outer peripheral edge, the stopper piece configured to engage the main body frame and support frame, by relatively moving them, and a lock mechanism configured to hold the stopper piece at a position to engage the main body frame with the support frame.

5. The luminaire according to claim 4, wherein the engagement unit further comprises: a shaft having the stopper piece, and a bearing configured to rotationally move the stopper piece around the shaft, and the lock mechanism is provided between the shaft and bearing, and secures the stopper piece to a rotational position to engage the main body frame with the support frame.

6. A luminaire comprising:

a light-emitting unit comprising:

a plurality light-emitting elements, a base substrate having a plate-shape on which two or more light-emitting elements are mounted, a plurality of reflectors attached on a side of the base substrate on which the light emitting elements are mounted, each of the reflectors having a reflection surface formed by slopes surrounding one of the light-emitting elements, and a terminal unit which is provided on the base substrate, and connected to the light-emitting elements;

a main body frame configured to support the light-emitting unit, and formed rectangular having a hook-shaped engaging piece on one side;

a support frame which is formed rectangular surrounding the outer periphery of the main body frame, and has a groove-shaped receiving place which engages with the engaging piece, on one interior side; and a lighting unit which turns on the light-emitting elements; wherein:

each of the reflectors has a jointing piece extending perpendicular from the outer periphery to the base substrate, and arranged so that the jointing piece is opposed to each other and the adjacent outer peripheries are fit, and the jointing pieces of the adjacent reflectors are united to each other by a fastening means, which determines the relative positions, and fastens the jointing pieces.

* * * * *